US009527279B2

(12) United States Patent
Kanzawa

(10) Patent No.: US 9,527,279 B2
(45) Date of Patent: Dec. 27, 2016

(54) LIQUID DROPLET DISCHARGE DEVICE, LIQUID DROPLET DISCHARGE METHOD, AND NON-TRANSITORY STORAGE MEDIUM STORING PROGRAM

(71) Applicant: Tomokazu Kanzawa, Kanagawa (JP)

(72) Inventor: Tomokazu Kanzawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/876,917

(22) Filed: Oct. 7, 2015

(65) Prior Publication Data

US 2016/0107440 A1 Apr. 21, 2016

(30) Foreign Application Priority Data

Oct. 17, 2014 (JP) ..... 2014-213008

(51) Int. Cl.
*B41J 2/045* (2006.01)
*B41J 2/14* (2006.01)

(52) U.S. Cl.
CPC ..... *B41J 2/04581* (2013.01); *B41J 2/0451* (2013.01); *B41J 2/0459* (2013.01); *B41J 2/04541* (2013.01); *B41J 2/04571* (2013.01); *B41J 2/14274* (2013.01); *B41J 2/04508* (2013.01); *B41J 2/04588* (2013.01); *B41J 2002/14354* (2013.01)

(58) Field of Classification Search
None
See application file for complete search history.

(56) References Cited

U.S. PATENT DOCUMENTS

2003/0020772 A1* 1/2003 Morikawa ..... B41J 2/0458 347/10
2012/0249638 A1* 10/2012 Takano ..... B41J 2/0454 347/10
2013/0307896 A1* 11/2013 Shinkawa ..... B41J 29/393 347/19
2015/0258780 A1 9/2015 Hayashi

FOREIGN PATENT DOCUMENTS

JP 2007-098691 4/2007
JP 3933506 6/2007
JP 2015-171807 10/2015

* cited by examiner

*Primary Examiner* — Lisa M Solomon
(74) *Attorney, Agent, or Firm* — Ipusa, PLLC

(57) ABSTRACT

A liquid droplet discharge device includes pressure chambers in communication with nozzles, wherein the pressure chambers are for storing ink; an oscillation plate that is disposed over the pressure chambers, so that an elastic wall of each of the pressure chambers is formed; pressure generating elements that are disposed to face the pressure chambers through the oscillation plate; a drive waveform generator for generating, for each of the nozzles, a drive waveform by using drive waveform data that indicates a shape of the drive waveform for driving the corresponding pressure generating element; a residual oscillation detector for detecting residual oscillation that is generated in each of the pressure chambers after driving the pressure generating elements; and a controller for correcting, during printing, the drive waveform data for each of the nozzles, based on a detection result by the residual oscillation detector.

10 Claims, 20 Drawing Sheets

LIQUID DROPLET DISCHARGE DEVICE, LIQUID DROPLET DISCHARGE METHOD, AND NON-TRANSITORY STORAGE MEDIUM STORING PROGRAM

BACKGROUND OF THE INVENTION

1. Field of the Invention

The present invention relates to a liquid droplet discharge device, a liquid droplet discharge method, and a non-transitory storage medium storing a program.

2. Description of the Related Art

An inkjet recording device has been known as an image recording device or an image forming device, such as a printer, a facsimile machine, and/or a copier. An inkjet recording device can form a desired character, a figure, and so forth on a recording medium (e.g., paper, metal, timber, or ceramics) by using an inkjet, recording head that includes, for example, a nozzle for discharging an ink droplet; a pressure chamber that is in communication with the nozzle; and a piezoelectric element for applying pressure to ink inside the pressure chamber.

A liquid injection device has been known that can discharge an ink droplet from a recording head under an optimum discharge condition by setting, for each nozzle or for each nozzle group, an initial value of a drive voltage for oscillating one or more flexible electrode based on a residual oscillation waveform (cf. Patent Document 1 (Japanese Unexamined Patent Publication No. 2007-98691), for example).

SUMMARY OF THE INVENTION

For a typical inkjet recording device, during printing, it may not be possible to correct a driving voltage for each nozzle, based on a detected residual oscillation waveform. Consequently, image quality may be lowered in such an inkjet recording device.

An embodiment of the present invention has been developed in view of the above-described problem. There is a need for enhancing image quality of an inkjet recording device.

According to an aspect of the present invention, there is provided a liquid droplet discharge device including a plurality of pressure chambers in communication with a plurality of nozzles, wherein the pressure chambers are configured to store ink; an oscillation plate that is disposed over the pressure chambers, so that an elastic wall of each of the pressure chambers is formed; pressure generating elements that are disposed to face the plurality of the pressure chambers through the oscillation plate; a drive waveform generator configured to generate, for each of the nozzles, a drive waveform by using, as an input, drive-waveform data that indicates a shape of the drive waveform for driving the corresponding pressure generating element; a residual oscillation detector configured to detect residual oscillation that is generated in each of the pressure chambers after driving the pressure generating elements; and a controller configured to correct, during printing, the drive waveform data for each of the nozzles, based on a detection result by the residual oscillation detector.

According to another aspect of the present invention, there is provided a liquid droplet discharge method that is to be executed by a liquid droplet discharge device, wherein the liquid droplet discharge device includes a plurality of pressure chambers in communication with a plurality of nozzles, wherein the pressure chambers are configured to store ink; an oscillation plate that is disposed over the pressure chambers, so that an elastic wall of each of the pressure chambers is formed; pressure generating elements that are disposed to face the plurality of the pressure chambers through the oscillation plate; a drive waveform generator configured to generate, for each of the nozzles, a drive waveform by using, as an input, drive waveform data that indicates a shape of the drive waveform for driving the corresponding pressure generating element; and a residual oscillation detector configured to detect residual oscillation that is generated in each of the pressure chambers after driving the pressure generating elements; and wherein the method includes a step of correcting, during printing, the drive waveform data for each of the nozzles, based on a detection result by the residual oscillation detector.

According to another aspect of the present invention, there is provided a non-transitory storage medium storing a program that is to be executed by a liquid droplet discharge device, wherein the liquid droplet discharge device includes a plurality of pressure chambers in communication with a plurality of nozzles, wherein the pressure chambers are configured to store ink; an oscillation plate that is disposed over the pressure chambers, so that an elastic wall of each of the pressure chambers is formed; pressure generating elements that are disposed to face the plurality of the pressure chambers through the oscillation plate; a drive waveform generator configured to generate, for each of the nozzles, a drive waveform by using, as an input, drive waveform data that indicates a shape of the drive waveform for driving the corresponding pressure generating element; and a residual oscillation detector configured to detect residual oscillation that is generated in each of the pressure chambers after driving the pressure generating elements; and wherein the program causes the liquid discharge device to execute a process of correcting, during printing, the drive waveform data for each of the nozzles, based on a detection result by the residual oscillation detector.

According to an embodiment of the present invention, image quality of an inkjet recording device can be enhanced.

Other objects, features and advantages of the present invention will become more apparent from the following detailed description when read in conjunction with the accompanying drawings.

DETAILED DESCRIPTION OF THE PREFERRED EMBODIMENTS

Figure 1:
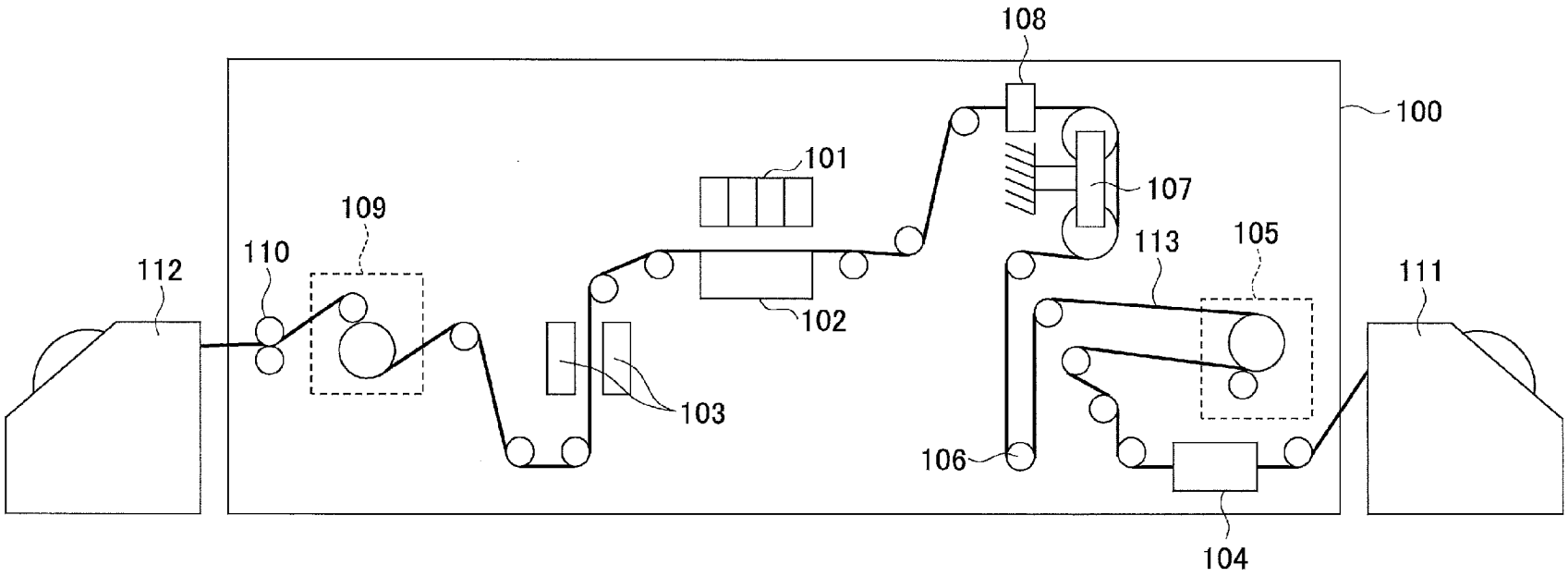
FIG. 1 is a diagram schematically showing an example of an inkjet recording device according to an embodiment.

Hereinafter, embodiments of the present invention are explained by referring to the drawings and the tables. In the drawings, like reference numerals are attached to similar components, and duplicate explanation may be omitted.

In this specification, a case is explained in which a piezoelectric element is used as a pressure generating element that is for applying pressure to ink inside a pressure chamber.

An Embodiment

Inkjet Recording Device

FIG. 1 is a schematic configuration diagram showing an example of a line scan type inkjet recording device according to an embodiment. The line scan type inkjet recording device that is shown in FIG. 1 may be an on-demand type recording device.

As shown in FIG. 1 the inkjet recording device 100 may be disposed between a recording medium supplying device 111 and a recording medium collecting device 112. The inkjet recording device 100 may include a recording unit 101; a platen 102 that is provided to face the recording unit 101; a dryer 103; a recording medium conveyor, and so forth.

A continuous recording medium 113 (which may be referred to as a roll sheet or a continuous paper sheet, for example) can be fed at high speed from the recording medium supplying device 111. The recording medium collecting device 112 can collect the recording medium 113 by winding it.

The recording unit 101 may include a line-shaped inkjet recording head. In the line-shaped inkjet recording head, nozzles (printing nozzles) can be disposed across the entire printing width. Color printing can be performed by using a black inkjet recording head, a cyan inkjet recording head, a magenta inkjet recording head, and a yellow inkjet recording head. A nozzle surface of each of the inkjet recording heads can be supported above the platen 102 in such a manner that the nozzle surface can be separated from the platen 102 by a predetermined distance. The recording unit 101 can form a color image on a printing surface of the recording medium 113 by discharging ink droplets in synchronization with conveying speed of the recording medium conveyor. The dryer 103 can dry and fix the ink, so that the ink that is printed on the recording medium 113 can be prevented from being adhered to another part. A contactless dryer may be used as the dryer 103. Alternatively, a contact dryer may be used as the dryer 103.

The recording medium conveyor may include a regulating guide 104; an in-feed unit 105; a dancer roller 106; an edge position control (EPC) 107; a meandering amount detector 108; an out-feed unit 109; a puller 110, and so forth. The regulating guide 104 is for positioning the recording medium 113 that is supplied from the recording medium supplying device 111 in a width direction. The in-feed unit 105 may include a driven roller and a driving roller. The in-feed unit 105 can keep tension of the recording medium 113 constant. The dancer roller 106 can move upward or downward, depending on the tension of the recording medium 113. The dancer roller 106 can output a position signal. The EPC 107 is for regulating meandering of the recording medium 113. The meandering amount detector 108 can be used for feeding back a meandering amount of the recording medium 113. The out-feed unit 109 may include a driven roller and a driving roller. The out-feed unit 109 can rotate at a constant speed so as to convey the recording medium 113 at a setting speed. The puller 110 may include a driven roller and a driving roller. The puller 110 is for ejecting the recording medium 113 outside the device. The recording medium conveyor is a tension control type conveyor such that tension on the recording medium 113 being conveyed can be kept constant by detecting a position of the dancer roller 106 and by controlling rotation of the in-feed unit 105.

The line scan type inkjet recording device 100 can discharge high viscosity ink by executing star flushing operation (i.e., idle discharge operation for discharging liquid droplets that are so small that they are almost invisible) and/or line flushing operation (e.g., idle discharge operation at a boundary of a sheet of A4 paper). The star flushing operation may not be advantageous because a sufficient effect of the idle discharge may not be obtained for an image having a low printing duty under a low humidity environment. However, the star flushing operation may be advantageous in a sense that paper sheets may not be wasted. The line flushing operation may not be advantageous in a sense that paper sheets may be wasted. That is, after discharging ink, it may become necessary to cut an area where the ink droplets are discharged. However, the line flushing operation may be advantageous because a sufficient effect of the idle discharge can be obtained.

A control method for recovering discharging performance of a head is explained below. During printing, ink inside the pressure chamber contacts outside air through openings of nozzles. Thus, due to changes in ambient temperature and humidity, self-heating by continuous driving, and so forth, the solvent may evaporate and viscosity may increase. During time period other than during printing, the ink inside the pressure chamber can be moisturized, for example, by covering the nozzles by a dedicated cap (a moisturizing cap). However, if a state in which the nozzles are covered by the cap continues for long time, the viscosity of the ink can also be increased. Consequently, the ink discharging speed may vary for each of the nozzles, and an abnormality in an image can be caused, such as uneven density, stripes, or color changes. Further, when the viscosity of ink is increased, the nozzles may be blocked (a discharging failure) by the high viscosity ink, and a missing dot (a defect on an image) may occur in an image forming area. Thus, in order for the head to recover the discharging performance, it is preferable that, during printing, a controller can correct, for each of the nozzles, drive-waveform data based on a result of detection of residual oscillation that is fed back.

As described in detail below, a liquid droplet discharge device according to the embodiment can detect, for each of nozzles, a time-dependent variation in viscosity of a liquid (ink viscosity) during printing, and the liquid droplet discharge device can correct drive-waveform data in real time. Consequently, occurrence of an abnormal image in a page can be suppressed, and image quality of the inkjet recording device can be enhanced.

<Inkjet Recording Head Module>

Figure 2:
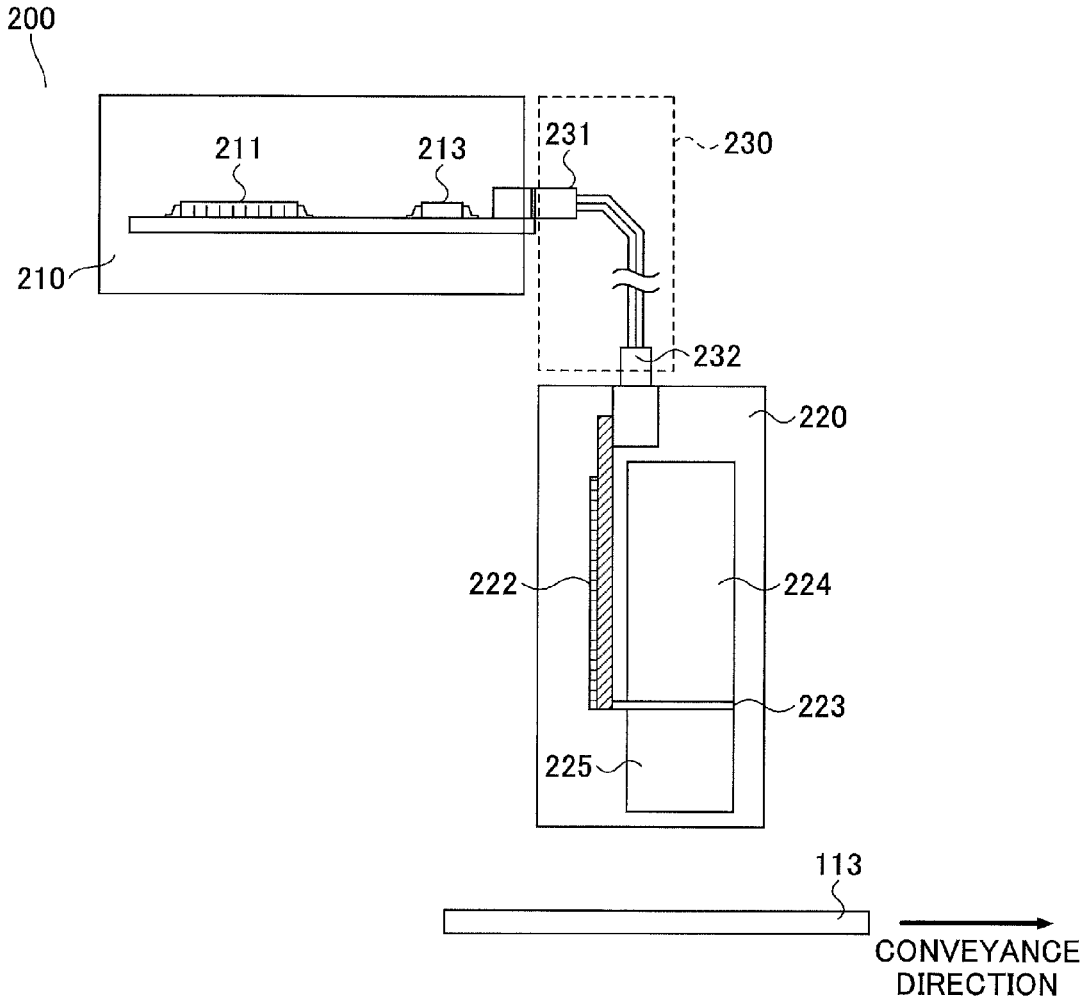
FIG. 2 is a side view schematically showing an example of a liquid droplet discharge device according to the embodiment.

FIG. 2 is a schematic side view showing an example of an inkjet recording head module that is to be installed in the inkjet recording device 100.

As shown in FIG. 2, an inkjet recording head module (the liquid droplet discharge device) 200 may include a drive control board 210; an inkjet recording head 220; a cable 230, and so forth.

The drive control board 210 may include a controller 211; a storage unit 213, and so forth. The inkjet recording head 220 may include a residual oscillation detection board 222; a head driving IC board 223; an ink tank 224; a rigid plate 225; a piezoelectric element connecting board 36 (cf. FIG. 5), and so forth. The cable 230 can be connected to a drive control board side connector. 231, and to a head side connector 232. The cable 230 can be used for analog signal communication and digital signal communication between the drive control board 210 and the piezoelectric element connecting board 36.

In the line scan type inkjet recording device 100, one or more inkjet recording head 220 can be arranged in a direction that is perpendicular to a conveyance direction in which the recording medium 113 can be conveyed. High speed image formation can be achieved by discharging ink droplets from the line scan type inkjet recording head 220 to the recording medium 113. Note that the liquid droplet discharge device according to the embodiment can be applied, for example, to a serial scan type inkjet recording device that can form an image by moving one or more inkjet recording heads in the direction that is perpendicular to the conveyance direction in which the recording medium 113 can be conveyed.

Figure 3:
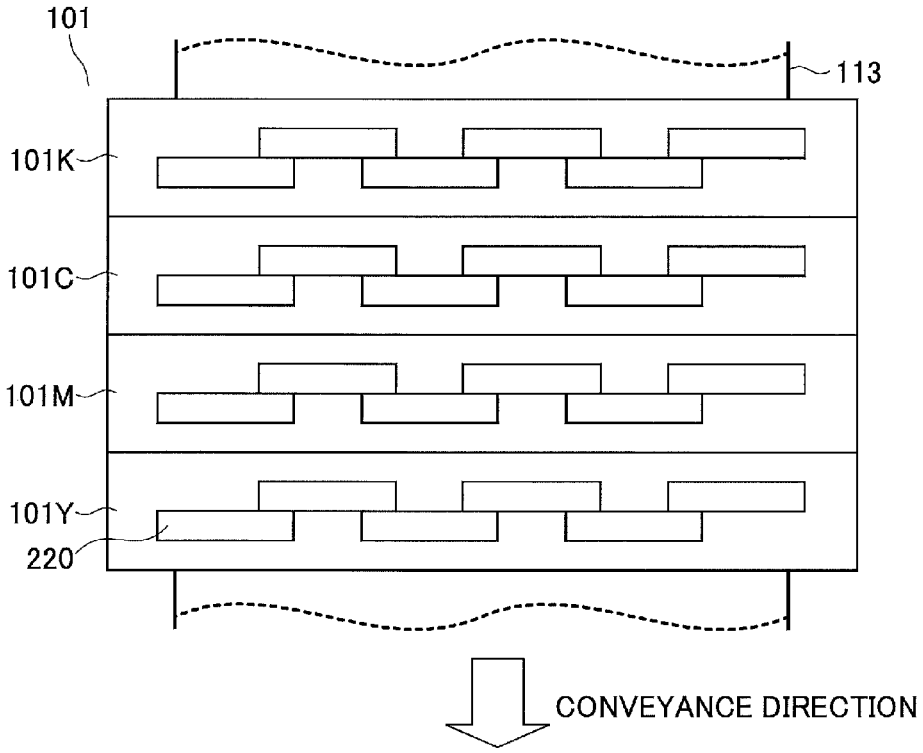
FIG. 3 is a plan view schematically showing an example of a recording unit according to the embodiment.

FIG. 3 is an enlarged plan view showing an example of a head portion of the recording unit 101 that is to be installed in the inkjet recording device 100.

The recording unit 101 may include a black head array 101K; a cyan head array 101C; a magenta head array 101M; and a yellow head array 101Y. The head array for each color may include a plurality of inkjet recording heads 220. The black head array 101K can discharge black ink droplets. The cyan head array 101C can discharge cyan ink droplets. The magenta head array 101M can discharge magenta ink droplets. The yellow head array 101Y can discharge yellow ink droplets.

The head array for each of the colors (101K, 101C, 101M, and 101Y) can be arranged in a direction that is parallel to the conveyance direction in which the recording medium 113 can be conveyed. The inkjet recording heads 220 can be arranged in a staggered manner in the direction that is perpendicular to the conveyance direction in which the recording medium 113 can be conveyed. By arranging the inkjet recording heads 220 in the staggered manner, the width of the printing area can be enlarged.

Figure 4:
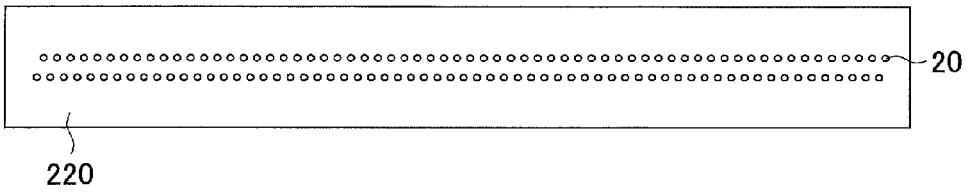
FIG. 4 is a bottom view schematically showing an example of an inkjet recording head according to the embodiment.

FIG. 4 is an enlarged plan view of the head portion of the inkjet recording head 220.

The inkjet recording head 220 may include a plurality of nozzles 20. The nozzles 20 can be arranged in a staggered manner in the direction that is perpendicular to the conveyance direction in which the recording medium 113 can be conveyed. By arranging the nozzles 20 in the staggered manner, a resolution of the printing area can be increased.

Note that, in the embodiment, the following configuration is shown as an example of the configuration of the recording unit 101. Namely, each row of the recording unit 101 includes three inkjet recording heads 220. Two rows of the recording unit 101 are arranged in the staggered manner. Each inkjet recording head 220 includes two nozzle sequences, and each nozzle sequence includes thirty two nozzles 20. The two nozzle sequences are arranged in the staggered manner. However, the number of the rows and the number of the inkjet recording head 220 that are included in each row are not particularly limited.

<Inkjet Recording Head>

Figure 5:
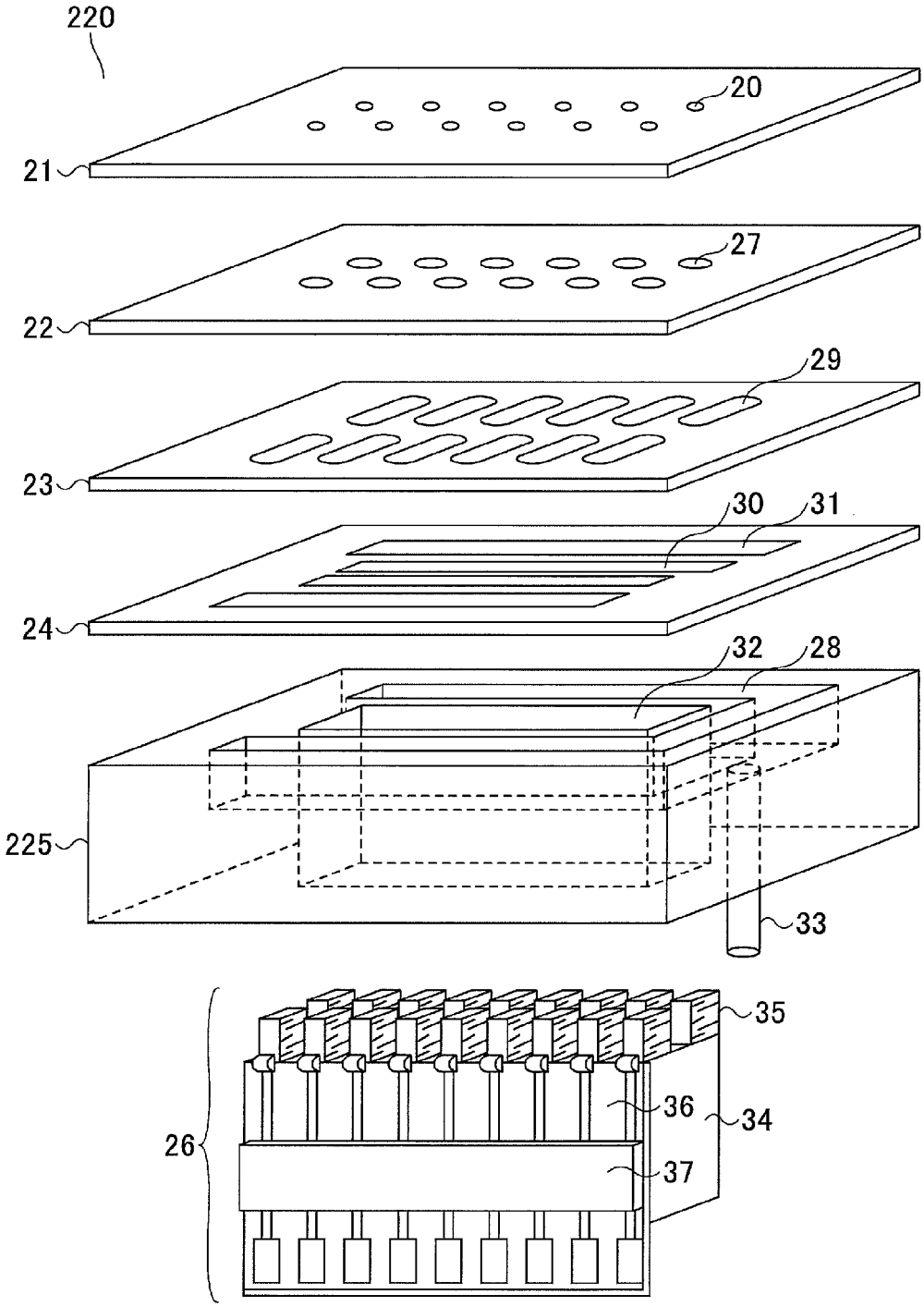
FIG. 5 is a perspective view schematically showing the example of the inkjet recording head according to the embodiment.

FIG. 5 is a perspective view showing an example of a configuration of the inkjet recording head 220 that is to be installed in the inkjet recording device 100.

As shown in FIG. 5, the inkjet recording head 220 may include a nozzle plate 21; a pressure chamber plate 22; a restrictor plate 23; a diaphragm plate 24; a rigid plate 225; a piezoelectric element group 26, and so forth. The piezoelectric element group 26 may include a supporting member 34; a plurality of piezoelectric elements 35; the piezoelectric element connecting board 36; a piezoelectric element driving IC 37, and so forth.

The nozzles 22 can be formed in the nozzle plate 21. In the pressure chamber plate 22, for each of the nozzles 22, a corresponding pressure chamber 27 can be formed. In the restrictor plate 23, a restrictor 29 can be formed. The restrictor 29 can connect the pressure chamber 27 and a common ink flow channel 28, so that the pressure chamber and the common ink flow channel 28 can be in communication. The restrictor 29 is for controlling an amount of the ink that flows into the pressure chamber 27. In the diaphragm plate 24, an oscillation plate (elastic wall) 30 and a filter 31 can be formed. By sequentially laminating these plates, and by positioning and joining these plates, a flow channel plate can be formed. The flow channel plate can be joined to the rigid plate 225. The filter 31 can face an opening 32 of the common ink flow channel 28. The piezoelectric element group 26 can be inserted into the opening 32. An upper opening end of the ink inlet pipe 33 can be connected to the common ink flow channel 28, and a lower opening end of the ink inlet pipe 33 can be connected to a head tank that can be filled with ink.

The piezoelectric elements 35 can be formed on the surface of the supporting member 34. A free end of each of the piezoelectric elements can be adhesively fixed to the oscillation plate 30. The piezoelectric element driving IC 37 can be formed on the surface of the piezoelectric element connecting board 36. Thus, the piezoelectric elements 35 and the piezoelectric element connecting board 36 can be electrically connected. The piezoelectric elements 35 can be controlled by the piezoelectric element driving IC 37 based on a drive waveform (e.g., a driving voltage waveform) that can be generated by a drive waveform generator. The piezoelectric element driving IC can be controlled based on image data that can be transmitted from an upper layer controller, or a timing signal that can be output from the controller 211, for example.

Note that, in FIG. 5, for simplicity of the drawing, the number of the nozzles 20, the number of the pressure chambers 27, the number of the restrictors 29, the number of the piezoelectric elements 35, and so forth are depicted to be smaller than the actual numbers.

<Detection of Residual Oscillation>

There is explained an example of detection of residual oscillation in the liquid droplet discharge device according to the embodiment by referring to FIGS. 6A, 6B-13.

Figure 6A:
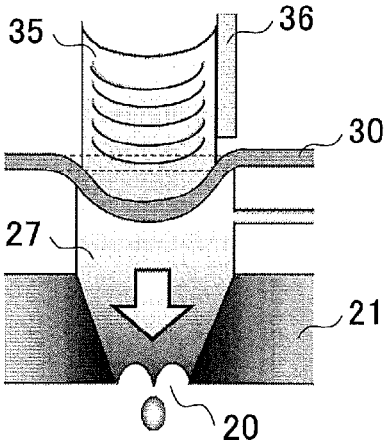
FIG. 6A is a conceptual diagram illustrating an example of residual oscillation according to the embodiment.
Figure 6B:
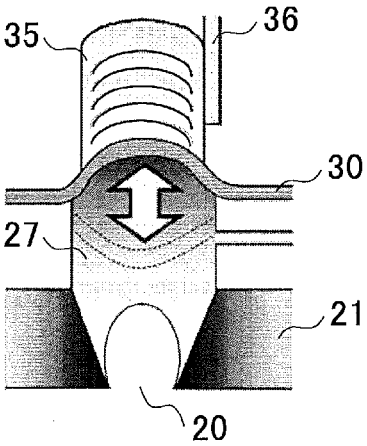
FIG. 6B is a conceptual diagram illustrating the example of the residual oscillation according to the embodiment.

FIGS. 6A and 6B are conceptual diagrams illustrating an example of residual oscillation that can occur in the ink inside the pressure chamber 27 of the inkjet recording head 220. FIG. 6A shows a state in which the ink droplet is discharged. FIG. 6B shows a state after the ink droplet is discharged. FIGS. 6A and 6B schematically illustrate the variation of the pressure that can be generated inside the pressure chamber 27.

Figure 7:
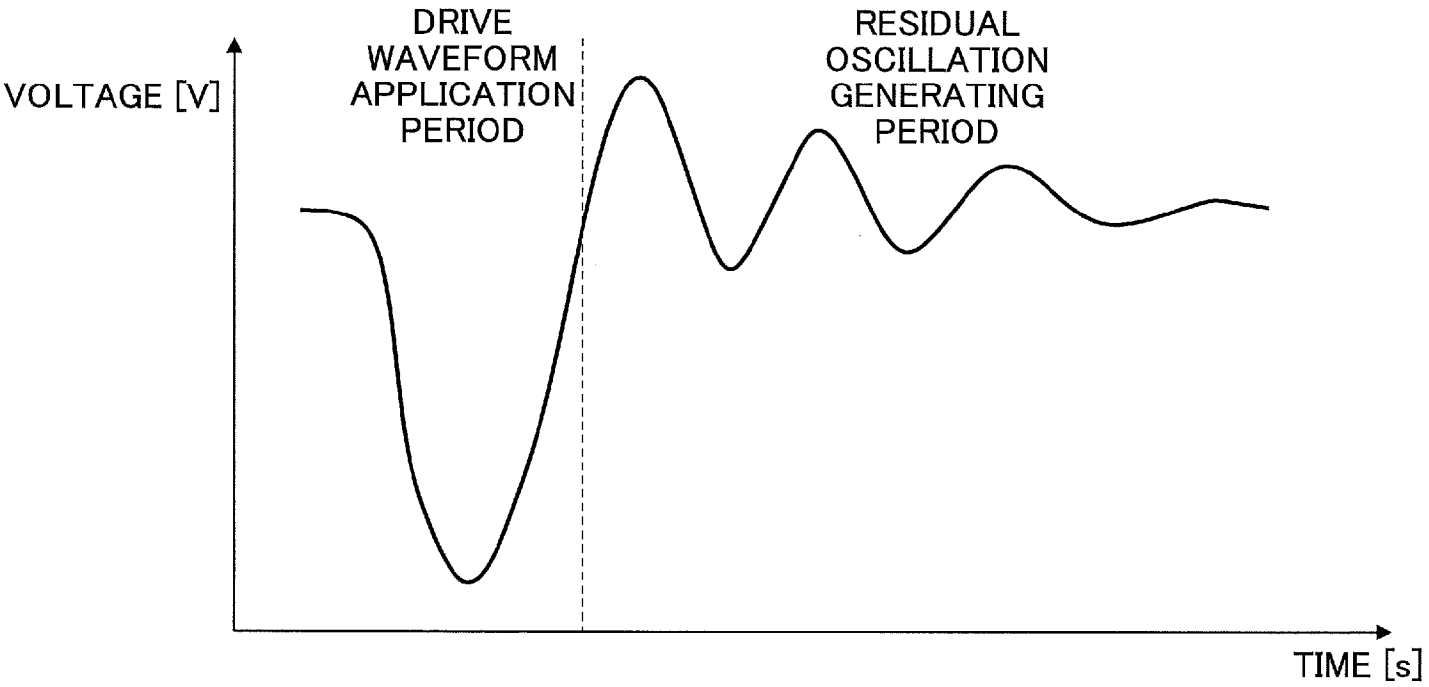
FIG. 7 is a diagram showing an example of a drive waveform application period and a residual oscillation generating period according to the embodiment.

FIG. 7 is a schematic diagram showing an example of a drive waveform application period and a residual oscillation generating period. The horizontal axis indicates time (second) and the vertical axis indicates a voltage (V). The drive waveform application period may correspond to FIG. 6A. The residual oscillation generating period may correspond to FIG. 6B.

As shown in FIG. 6A, in response to application of the drive waveform that is generated by the drive waveform generator 212 to the piezoelectric element 35 (specifically an electrode of the piezoelectric element 35), the piezoelectric element 35 can expand and contract. Stretching force can act on the ink inside the pressure chamber 27 from the piezoelectric element 35 through the oscillation plate 30. In response to occurrence of a change in pressure inside the pressure chamber 27, an ink droplet can be discharged from the nozzle 20. For example, by an attenuating operation for attenuating the drive waveform, the pressure inside the pressure chamber 27 can be decreased. By an amplifying operation for amplifying the drive waveform, the pressure inside the pressure chamber 27 can be increased (cf. the drive waveform application period shown in FIG. 7).

As shown in FIG. 6B, after the drive waveform is applied to the piezoelectric element 35 (after the ink droplet is discharged), residual pressure oscillation can occur in the ink inside the pressure chamber 27, and the residual pressure oscillation can propagate from the ink inside the pressure chamber 27 to the piezoelectric element 35 through the oscillation plate 30. A residual oscillation waveform of the residual pressure wave can be a damped oscillation waveform (cf. the residual oscillation generating period shown in FIG. 7). As a result, a residual oscillation voltage can be induced in the piezoelectric element 35 (specifically, the electrode of the piezoelectric element connecting board 36). A residual oscillation detector 240 can detect the residual oscillation voltage, and the residual oscillation detector 240 can output, as an output of the residual oscillation detector 240, a result of the detection (e.g., a digital signal that is obtained by applying analog-to-digital (AD) conversion to an amplitude value of the residual oscillation waveform that is fixed to the peak value) to the controller 211.

In this manner, the liquid droplet discharge device according to the embodiment, the residual oscillation detector 240 can detect the residual oscillation based on stretching of the piezoelectric element 35, and the controller 211 can determine the viscosity of the ink based on the output of the residual oscillation detector 240. Here, the residual oscillation waveform may be the damped oscillation waveform. Thus, as a method of determining the viscosity of the ink based on the output of the residual oscillation detector 240, a damping ratio of the damped oscillation can be focused on. By focusing on the damping ratio of the damped oscillation, the controller 211 can accurately determine the viscosity of the ink, even if the configuration of the circuit is simple.

Figure 8:
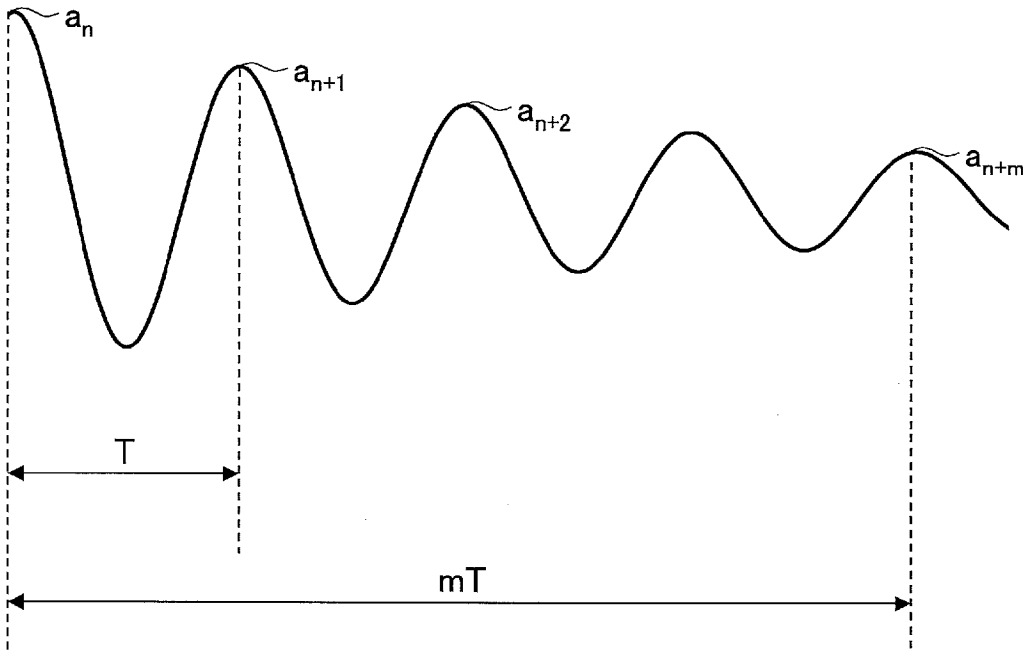
FIG. 8 is a diagram showing an example of damped oscillation according to the embodiment.
Figure 9:
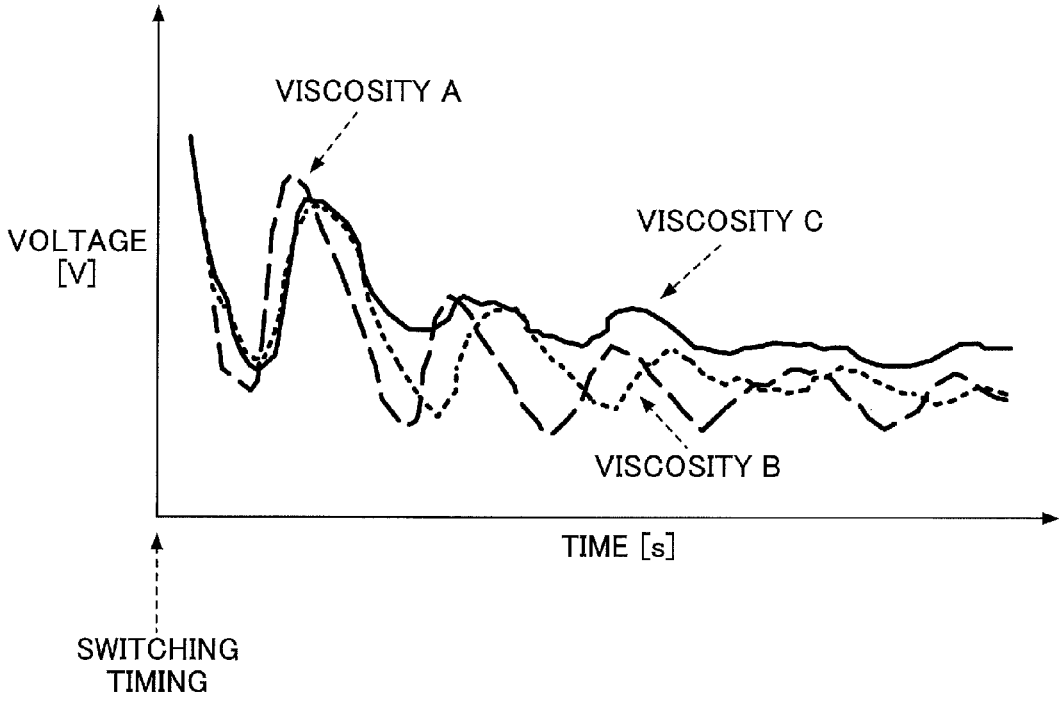
FIG. 9 is a diagram showing an example of a relationship between an actually measured residual oscillation waveform and ink viscosity according to the embodiment.

Next, there are explained, by referring to FIGS. 8 and 9, a process of calculating the damping ratio of the damping oscillation from the amplitude values of the residual oscillation waveform, and a relationship between the amplitude values of the residual oscillation waveform and the ink viscosity.

A theoretical formula of damped oscillation can be expressed by "Expression 1," where x is a displacement of the damped oscillation with respect to time, $x_0$ is an initial displacement, $\zeta$ is a damping ratio, $\omega_0$ is a harmonic oscillation frequency, $\omega_d$ is a harmonic oscillation frequency of the damped system, $v_0$ is an initial displacement amount, and t is the time.

$$x = e^{-\zeta\omega_0 t}\left(x_0\cos\omega_d t + \frac{\zeta\omega_0 x_0 + v_0}{\omega_d}\sin\omega_d t\right) \quad \text{<Expression 1>}$$

The harmonic oscillation frequency $\omega_d$ can be expressed by "Expression 2."

$$\omega_d = \sqrt{1-\zeta^2}\,\omega_0 \quad \text{<Expression 2>}$$

By assuming that $a_n$ is the n-th amplitude value, and that $a_{n+m}$ is the (n+m)-th amplitude value, a logarithmic damping ratio $\delta$ can be expressed by "Expression 3." Here, the logarithmic damping ratio $\delta$ is a parameter that may be required for calculating the damping ratio $\zeta$.

$$\delta = \frac{1}{m}\cdot\ln\frac{a_n}{a_{n+m}} \quad \text{<Expression 3>}$$

In FIG. 8, T is one period, mT is m periods, $a_n$ is the n-th amplitude value, $a_{n+1}$ is the (n+1)-th amplitude value, $a_{n+2}$ is the (n+2)-th amplitude value, and $a_{n+m}$ is the (n+m)-th amplitude value (note that n and m are natural numbers).

The logarithmic damping ratio $\delta$ is an average value, per one period, of a ratio of amplitude variation that is expressed in the logarithmic scale. The logarithmic damping ratio $\delta$ can be obtained by expressing the ratio of the amplitude variation in the logarithmic scale and dividing the resultant value by m. Thus, the damping ratio ζ can be expressed by "Expression 4" by using the logarithmic damping ratio δ.

$$\zeta = \frac{\delta}{2\pi} \quad \text{<Expression 4>}$$

The damping ratio ζ may include information of an average value of the damping ratio of the amplitude value per one period, which can be obtained by averaging the damping ratio of the amplitude value for a plurality of periods.

Thus, in order to calculate the damping ratio ζ of the damped oscillation from <Expression 1> to <Expression 4>, it suffices if the logarithmic damping ratio δ is obtained. In order to obtain the logarithmic damping ratio δ, it suffices if amplitude values of at least two parts of the damped oscillation can be recognized.

Here, FIG. 9 shows an example of a relationship between an actually measured residual oscillation waveform and the ink viscosity. The vertical axis indicates a voltage (V). The horizontal axis indicates time (second). The origin of the time axis indicates a switching timing for switching from the drive waveform application period to the residual oscillation generating period. The scale of the ink viscosity can be expressed as follows. If the viscosity A is 1, the viscosity B is 1.7 and the viscosity C is 3.

From FIG. 9, it can be seen that the amplitude value in the actually measured residual oscillation waveform for the viscosity A=1 is the largest value. The amplitude value in the actually measured residual oscillation waveform for the viscosity C=3 is the smallest value.

Namely, the smaller the ink viscosity is, the greater the amplitude of the damped oscillation becomes or the smaller the damping ratio of the damped oscillation becomes. It can be seen that the actually measured residual oscillation waveform and the ink viscosity are correlated.

Figure 10:
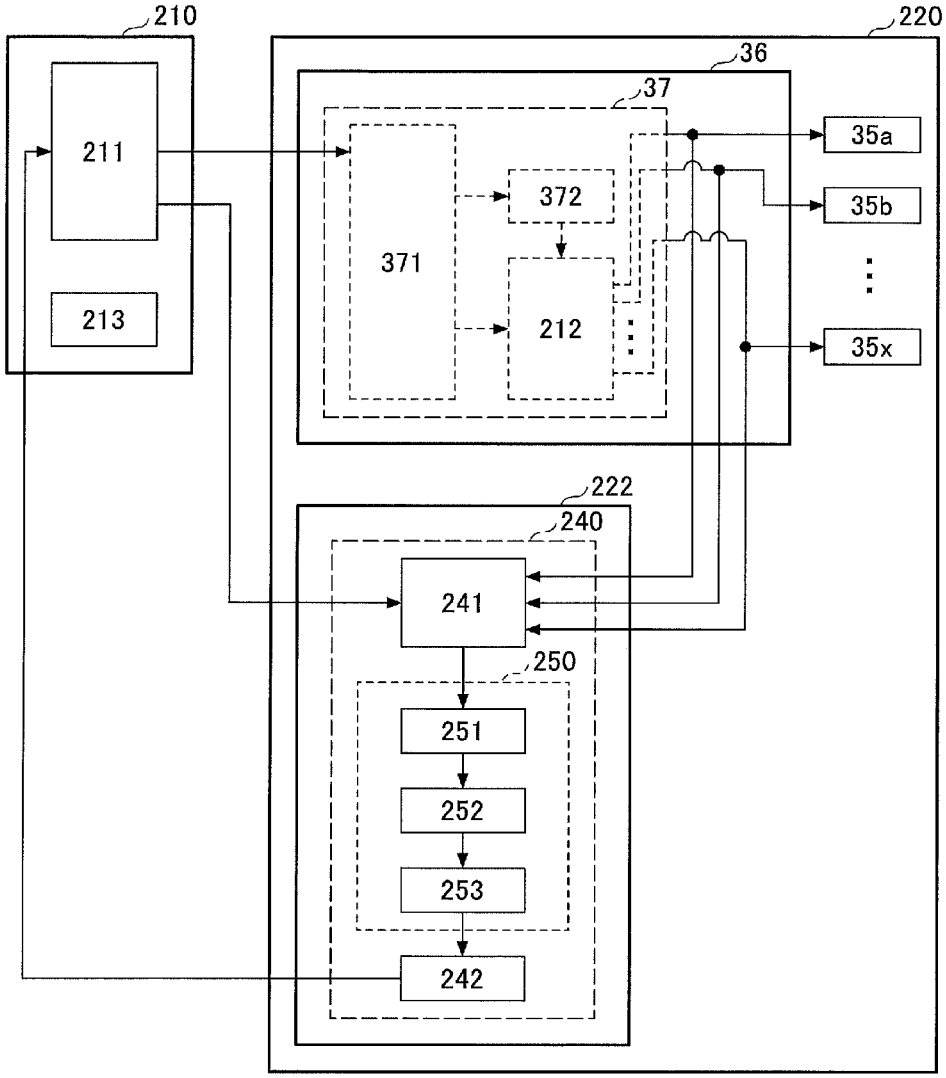
FIG. 10 is a block diagram illustrating an example of a functional configuration of the liquid droplet discharge device according to the embodiment.

FIG. 10 is a block diagram showing an example of the inkjet recording head module 200 that can be installed in the inkjet recording device 100 according to the embodiment.

The inkjet recording head module 200 may include the drive control board 210; the inkjet recording head 220, and so forth. The drive control board 210 may include the controller 211, the storage unit 213, and so forth. The inkjet recording head 220 may include the residual oscillation detection board 222; the piezoelectric element connecting board 36; the piezoelectric elements 35 (piezoelectric elements 35*a* to 35*x*), and so forth. The residual oscillation detector 240 can be installed in the residual oscillation detection board 222. The piezoelectric element driving IC 37 can be installed in the piezoelectric element connecting board 36. A waveform processing circuit 250, a switching unit 241, an analog-to-digital (A/D) converter 242, and so forth can be installed in the residual oscillation detection board 222. The drive waveform generator 212, a serial-to-parallel converter 371, a controller 372, and so forth can be installed in the piezoelectric element driving IC 37. The waveform processing circuit 250 may include a filter circuit 251; an amplifier circuit 252; a peak hold circuit 253, and so forth.

Note that some of functions or all the functions of the controller 211 that can be installed in the drive control board 210 and the controller 372 that can be installed in the piezoelectric element driving IC 37 can be integrated into one of them. Additionally or alternatively, some of functions or all the functions of the residual oscillation detection board 222 can be integrated into the drive control board 210.

The controller 211 can generate drive waveform data based on image data that is received from an upper layer controller (not shown), and the controller 211 can output the generated waveform data to the piezoelectric element driving IC 37. The controller 211 can transmit, by serial communications, a timing control signal (a digital signal) to the piezoelectric element driving IC 37 and the switching unit 241, and the controller 211 can transmit a switching signal that is synchronized with the timing control signal to the switching unit 241. By synchronizing the timing control signal with the switching signal, the controller 211 can control the timing for applying, to the residual oscillation detection board 222, a residual oscillation voltage that is induced in the electrodes of the piezoelectric element connecting board 36.

Additionally, the controller 211 can select at least two digital signals from the output of the residual oscillation detector 240 (e.g., digital signals that can be obtained by applying analog-to-digital conversion to the corresponding amplitude values (which are obtained by fixing at the corresponding peak values) of the residual oscillation waveform) that is fed back for each of the nozzles 20 by the residual oscillation detector 240. The controller 211 can calculate the damping ratio of the damped oscillation by using <Expression 1> to <Expression 4>. As the number of the amplitude values that are to be selected is increased, accuracy of calculating the damping ratio can be increased.

Furthermore, the controller 211 can accurately detect the ink viscosity inside the pressure chamber 27 by comparing the calculated damping ratio with damping ratio data that is stored in the storage unit 213. Then, the controller 211 can correct, for each of the nozzles 20, the drive waveform data, based on the ink viscosity. In this manner, the drive waveform generator 212 can apply, for each of the nozzles 20, an optimum drive waveform so as to drive the piezoelectric elements 35 (the piezoelectric elements 35*a* to 35*x*).

The storage unit 213 can store the damping ratio data in advance.

The serial-to-parallel converter 371 can convert the drive waveform data (a serial signal) that is corrected by the controller 211 into a parallel signal, and the serial-to-parallel converter 371 can output the parallel signal to the drive waveform generator 212 and the controller 372.

The controller 372 can deserialize the timing control signal, and the controller 372 can output, to the drive waveform generator 212, a signal that corresponds to the timing control signal. The drive waveform generator 212 can apply digital-to-analog conversion to the drive waveform data (a parallel signal). Then, the drive waveform generator 212 can generate a drive waveform by amplifying the voltage and the current, and the drive waveform generator 212 can output the generated drive waveform to the piezoelectric element driving IC 37.

Based on the timing control signal, ON/OFF control can be applied to the piezoelectric element driving IC 37. For example, in response to detect that the timing control signal is ON (OFF), a drive waveform that is generated for each of the nozzles 20 by the drive waveform generator 212 is applied (not applied) to the corresponding piezoelectric element (cf. the drive waveform application period that is shown in FIG. 7). In accordance with the attenuating operation and/or the amplifying operation of the drive waveform, the piezoelectric elements 35 can be stretched. In response to driving of the piezoelectric elements 35, ink droplets can be discharged from the corresponding nozzles 20.

In the waveform processing circuit 250, a filtering process can be applied to a residual oscillation waveform by the filter circuit 251, and the filtered residual oscillation waveform can be amplified by the amplifier circuit 252. Then, by the peak hold circuit 253, a peak value (e.g., a maximum value) of the amplitude values of the residual oscillation waveform can be detected and extracted, and the peak hold circuit 253 can hold the peak value.

The switching unit 241 can switch between connection and disconnection of the piezoelectric elements 35 and the waveform processing circuit 250. For example, in response to detecting that the piezoelectric elements 35 and the waveform processing circuit 250 are connected by the switching unit 241, the residual oscillation voltage that is induced in the electrodes of the piezoelectric element connecting board 36 can be applied to the waveform processing circuit 250.

The A/D converter 242 can convert the amplitude value (an analog signal) that is held by the waveform processing circuit 250 into a digital signal, and the A/D converter 242 can output (feed back) the digital signal to the controller 211. The controller 211 (or it may be a controller 226) can calculate the damping ratio of the damped oscillation based on the output (the detection result) of the residual oscillation detector 240 that is fed back.

Note that, in FIG. 10, the residual oscillation voltages of the piezoelectric elements 35*a* to 35*x* can be detected by sequentially switching the set of the residual oscillation detector 240 (the switching unit 241, the waveform processing circuit 250, and the A/D converter 242). However, the configuration of the residual oscillation detector 240 is not limited to this. For example, for each of all the piezoelectric elements 35*a* to 35*x*, a corresponding residual oscillation detector 240 can be formed, and ink viscosity in all the pressure chambers 27 can be simultaneously detected. Alternatively, the piezoelectric elements 35*a* to 35*x* can be divided into some groups, for example. For each of the groups, a corresponding residual oscillation detector 240 can be formed, and ink viscosity in the pressure chambers 27 can be detected by sequentially switching the residual oscillation detectors 240 for the corresponding groups. By dividing the piezoelectric elements 35*a* to 35*x* into some groups, the number of the nozzles 20 for which the ink viscosity can be simultaneously detected can be increased while suppressing an increase in circuit size.

Figure 11:
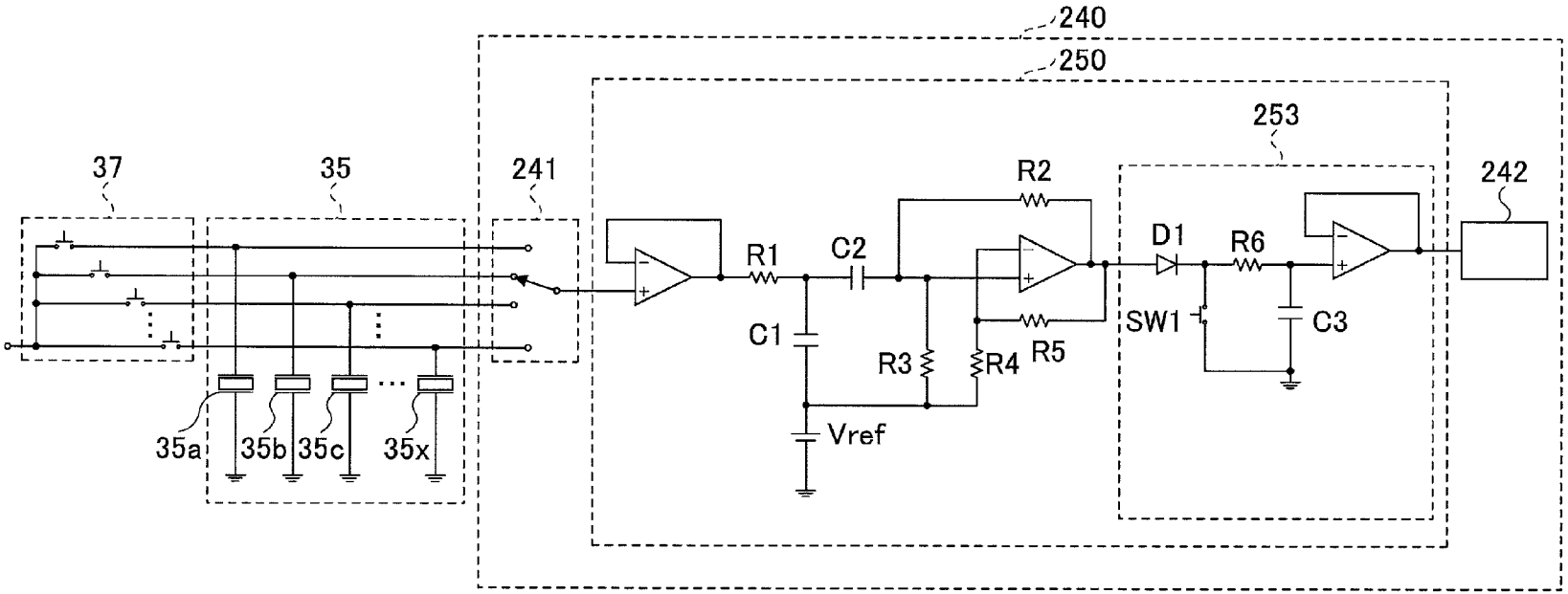
FIG. 11 is a circuit diagram illustrating an example of a circuit configuration of a residual oscillation detector according to the embodiment.

FIG. 11 is a circuit diagram illustrating an example of the residual oscillation detector 240 according to the embodiment.

The piezoelectric element driving IC 37 may include a plurality of switching elements. The piezoelectric element driving IC 37 can be turned on or turned off by turning on or turning off the switching elements that are formed for the corresponding piezoelectric elements 35*a* to 35*x*. After the ink droplets are discharged (the piezoelectric element driving IC 37 is turned off), by electrically connecting the piezoelectric elements 35 and the waveform processing circuit 250, the residual oscillation detector 240 can detect the residual oscillation voltages that can be induced in the piezoelectric elements 35, and the residual oscillation detector 240 can detect the amplitude values of the residual oscillation waveform.

By receiving an infinitesimal residual oscillation waveform by using a buffer unit having a high impedance, the waveform processing circuit 250 can suppress an adverse effect on the residual oscillation waveform by the detection circuit. Constants of passive elements that can be included in the waveform processing circuit 250, such as resistors R1 to R5 and capacitors C1 to C3, can preferably variably controlled by the controller 211, depending on a difference in a harmonic oscillation frequency that can be caused by a characteristic of the inkjet recording head 220.

The filter circuit 251 can apply a filtering process to the residual oscillation waveform. The filter circuit 251 can have a predetermined pass-band width having a center frequency that is the harmonic oscillation frequency. For example, in the filter circuit 251, a band width whose level is −3 dB from the level of both ends of the pass-band width can preferably be set to be three times as large as the passing-band width. In this manner, variations in the harmonic oscillation frequency that can be caused by production variation of the inkjet recording head 220 can be absorbed, and at the same time, high frequency noise and low frequency noise can be effectively removed.

Figure 12:
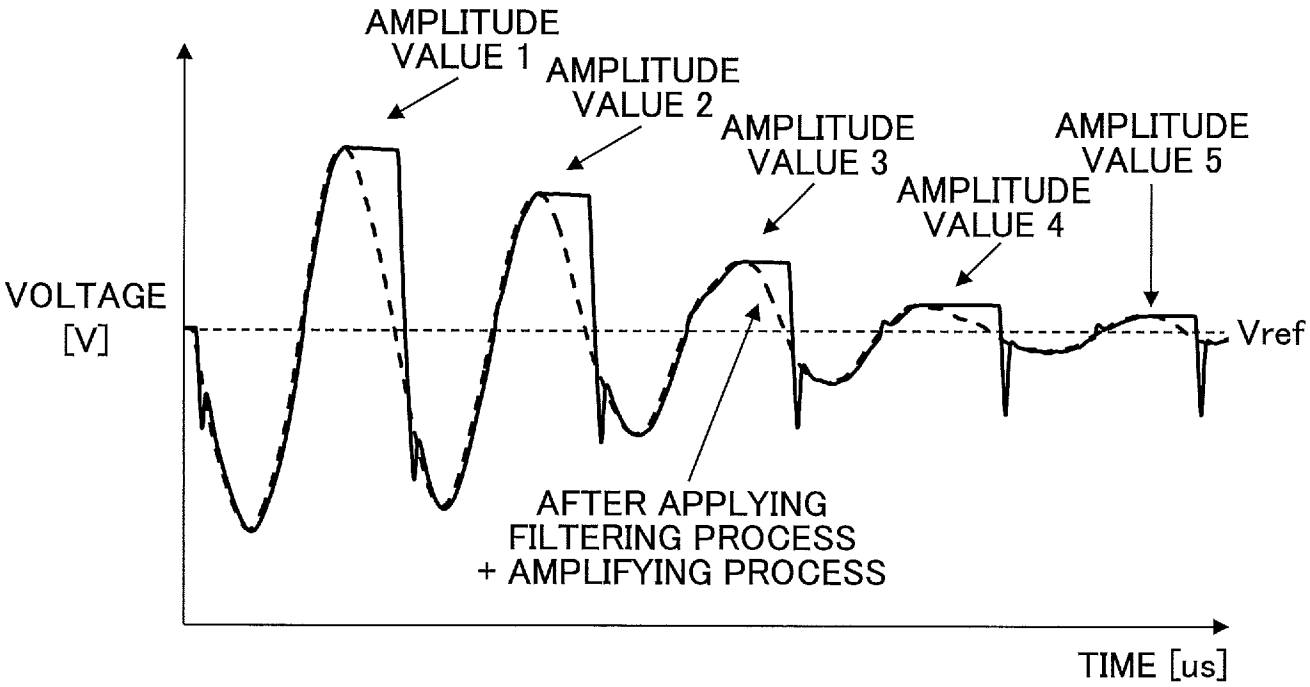
FIG. 12 is a diagram illustrating an example of a residual oscillation waveform according to the embodiment.

The amplifier circuit 252 can amplify the residual oscillation waveform to which the filtering process is applied (cf. the dotted line shown in FIG. 12). In the amplifier circuit 252, an amplification factor can preferably adjusted so that the waveform can be amplified within a range in which the amplified waveform can be input into the A/D convertor 242.

Note that, by configuring the filter circuit 251 and the amplifier circuit 252 to be a band-pass filter amplifier (a Sallen-key type), noise components can be effectively removed, and signal components can be effectively extracted. However, the configuration of the filter circuit 251 and the amplifier circuit 252 is not limited to this. It suffices if the filter circuit 251 and the amplifier circuit 252 includes, at least, a circuit that is formed by combining a filter having a high-pass characteristic and a low-pass characteristic, and a non-inverting amplifier or a inverting amplifier.

The peak hold circuit 253 can recognize and extract a peak value of the amplitude values of the residual oscillation waveform, and the peak hold circuit 253 can hold the peak value (cf. the solid line shown in FIG. 12). In the peak hold circuit 253, discharge duration of the register R6 and the capacitor C3 can preferably be adjusted so that the discharge duration becomes less than or equal to a half of a period of the residual oscillation. The peak hold circuit 253 can be reset by the controller 211 by outputting a reset signal to the switching element SW1 at a timing at which the raising edge of the damped oscillation waveform intersects a reference voltage Vref. The reset timing can be a timing from which the peak hold circuit 253 can recognize the amplitude values of the damped oscillation waveform. The reset timing can be detected by a comparator (not shown). Note that the configuration of the peak hold circuit 253 is not limited to the configuration that is shown in FIG. 11. It suffices if the peak hold circuit 253 includes, at least, a circuit that can hold a peak value of the amplitude values of the residual oscillation waveform.

FIG. 12 shows an example of a waveform (which is indicated by the dotted line) that is formed by applying a filtering process and an amplification process by using the circuit that is shown in FIG. 11, and a waveform (which is, indicated by the solid line) that is formed by holding peak values of the amplitude values by using the circuit that is shown in FIG. 11.

The amplitude values are held at the peak values at the corresponding five points. The amplitude value of the first half wave is defined to be an amplitude value 1. The amplitude value of the second half wave is defined to be an amplitude value 2. The amplitude value of the third half wave is defined to be an amplitude value 3. The amplitude value of the fourth half wave is defined to be an amplitude value 4. The amplitude value of the fifth half wave is defined to be an amplitude value 5. The sharp waveforms that can be observed below the reference voltage Vref are undershoots that are caused by discharging the capacitor C3 at a very short time interval.

The damping ratio ζ can be calculated by the controller 211 by selecting at least two values among the amplitude values 1 to 5, and by using <Expression 3> and <Expression 4>. In FIG. 12, the waveform is shown that is obtained by detecting the amplitude value 1 to the amplitude value 5 at the upper side of the amplitude in the vertical direction. Thus, the damping ratio ζ can be calculated that is averaged over four periods. However, the damping ratio ζ can be calculated by detecting the amplitude values at the lower side of the amplitude in the vertical direction. When the amplitude values at the upper side of the amplitude in the vertical direction are used for calculating the damping ratio ζ, an amplifier circuit can be used for the waveform processing circuit 250. When the amplitude values at the lower side of the amplitude in the vertical direction are used for calculating the damping ratio ζ, an inverting amplifier circuit can be used for the waveform processing circuit 250.

Note that, by properly selecting the amplitude values, the controller 211 can enhance accuracy of calculating the damping ratio ζ. For example, the controller 211 may remove the amplitude value 1 because the amplitude value 1 can be affected by variation in the characteristic of the switching unit 241. Then, the controller 211 may select the amplitude values that are used for calculation among the amplitude value 2, the amplitude value 3, the amplitude value 4, and the amplitude value 5. Alternatively, the controller 211 may remove the smallest amplitude value (e.g., the amplitude value 5) because a detection error tends to be greater for the smallest amplitude value. Then, the controller 211 can select the amplitude values that are used for calculation among the amplitude value 1, the amplitude value 2, the amplitude value 3, and the amplitude value 4, for example. Alternatively, the controller 211 may remove both the amplitude value 1 and the amplitude value 5, and the controller 211 may select the amplitude values that are used for calculation among the amplitude value 2, the amplitude value 3, and the amplitude value 4, for example. Alternatively, the controller 211 may remove a half wave in which the effect of disturbance and noise is significant. Then, the controller 211 may calculate the damping ratio ζ by averaging over periods excluding the period of the removed half wave.

Figure 13:
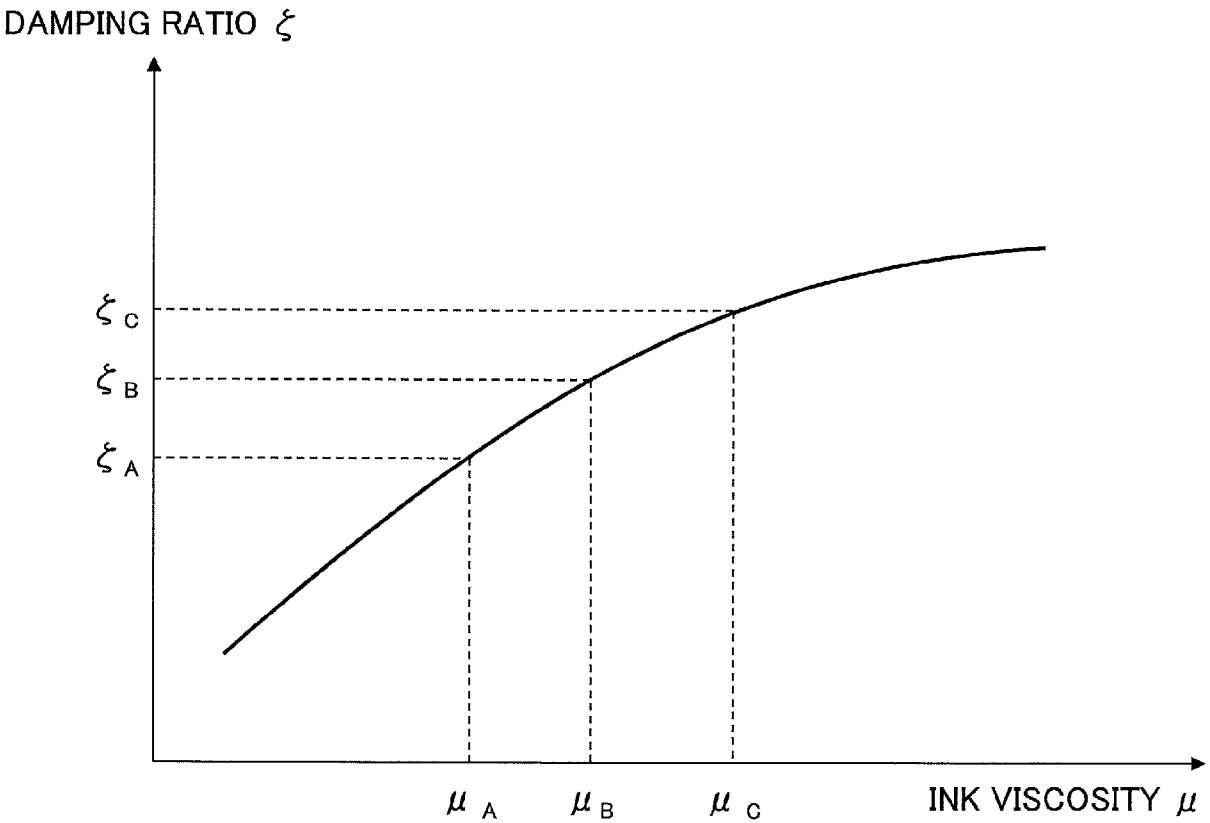
FIG. 13 is a diagram showing an example of a relationship between a damping factor $\zeta$ and the ink viscosity $\mu$ according to the embodiment.

FIG. 13 is a diagram showing a relationship between the damping ratio ζ and the ink viscosity μ. Here, the damping ratio ζ is calculated by using the amplitude values (some of the amplitude value 1, the amplitude value 2, the amplitude value 3, the amplitude value 4, and the amplitude value 5) that are shown in FIG. 12.

From FIG. 13, it can be seen that, as the ink viscosity μ increases, the damping ratio ζ becomes greater. Namely, the damping ratio ζ and the ink viscosity μ are correlated.

Figure 14:
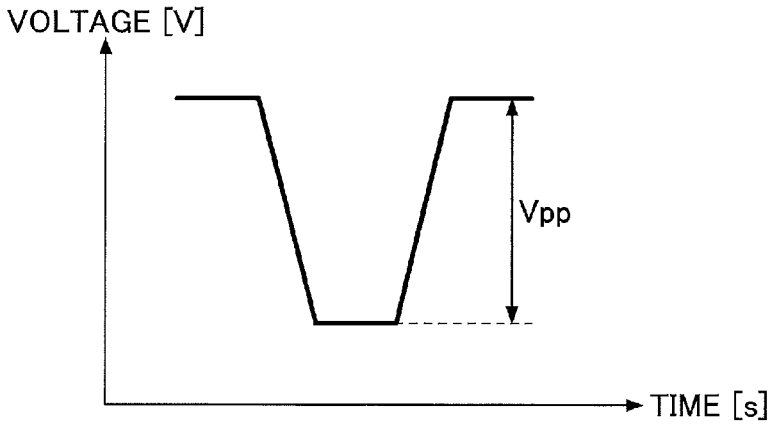
FIG. 14 is a diagram showing an example of a drive waveform according to the embodiment.

FIG. 14 is a diagram showing an example of a drive waveform. The horizontal axis indicates time (second). The vertical axis indicates a voltage (V).

The voltage amplitude Vpp of the trapezoidal waveform that is shown in FIG. 14 is in proportion to liquid droplet discharge speed and a discharge amount. For example, when the controller 211 determines that the ink viscosity is increased based on the calculated damping ratio, the liquid droplet discharge speed and the discharge amount may be reduced. Thus, in this case, the liquid droplet discharge speed and the discharge amount can be corrected by increasing the voltage gain of the drive waveform so as to increase the voltage amplitude Vpp.

In other words, for each of the values of the ink viscosity (cf. FIG. 13) that is determined by the controller 211, the drive waveform generator 212 can generate a drive waveform having a corresponding different voltage amplitude Vpp, and the drive waveform generator 212 can apply the generated drive waveform to the piezoelectric elements 35. In this manner, the drive waveform generator 212 can apply an optimum drive waveform to the piezoelectric elements 35.

Note that the controller 211 may repeat the detection and the correction of the output of the residual oscillation detector 240 without converting the damping ratio into the ink viscosity, so that the detected damping ratio is within a predetermined range. The predetermined range is not particularly limited. However, the predetermined range can be a range within which the liquid discharge speed and the discharge amount are kept constant.

Figure 15:
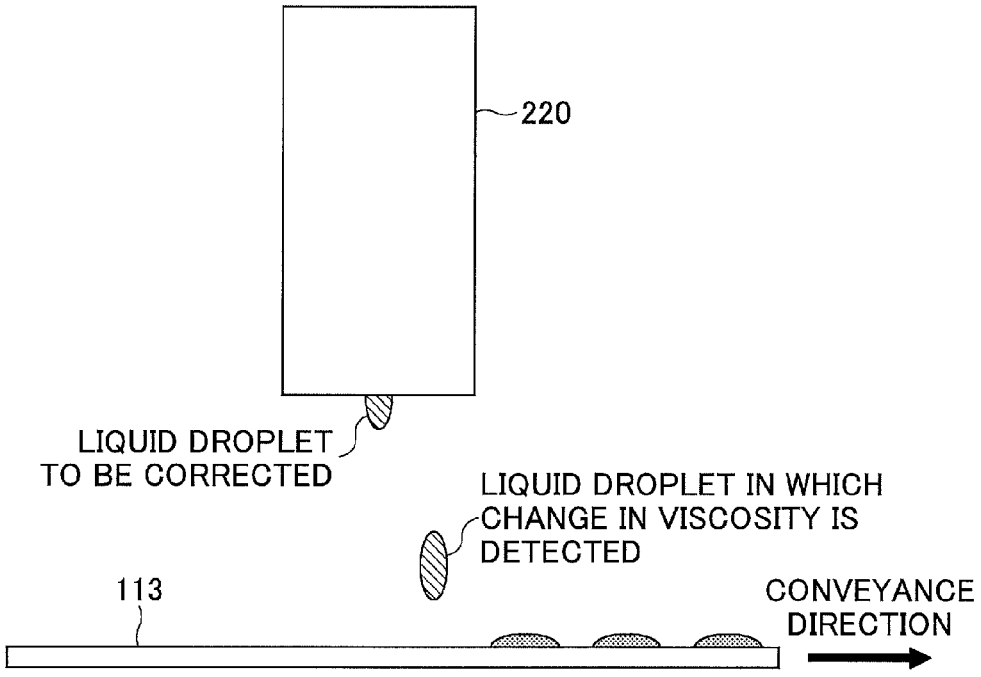
FIG. 15 is a diagram illustrating an example of correction timing according to the embodiment.

FIG. 15 is a diagram illustrating an example of a timing at which the controller 211 corrects the drive waveform data.

A case is explained in which the residual oscillation detector 240 detects a change in the ink viscosity during a process of forming an image on the recording medium 113 while conveying the recording medium 113 in the conveyance direction (cf. the arrow in the figure).

In this case, the controller 211 starts correcting the drive waveform data from the liquid droplet immediately after the liquid droplet in which a change in the ink viscosity is detected. In this manner, the liquid droplet discharge device can suppress occurrence of an abnormal image within a page.

Figure 16:
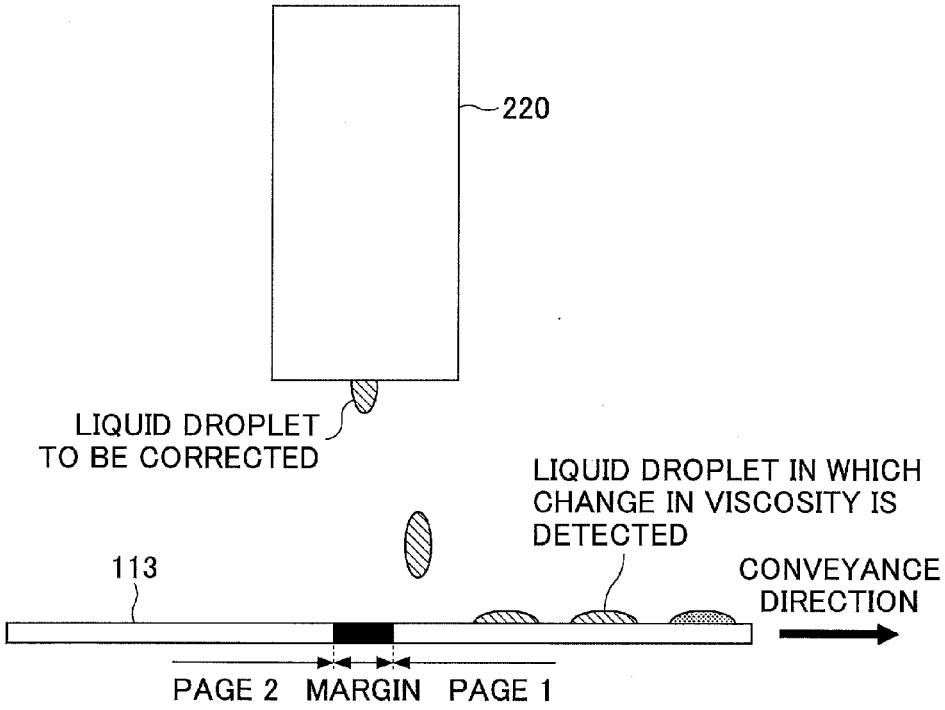
FIG. 16 is another diagram illustrating the example of the correction timing according to the embodiment.

FIG. 16 is a diagram illustrating an example of a timing at which the controller 211 corrects the drive waveform data.

A case is explained in which the residual oscillation detector 240 detects a change in the ink viscosity during printing a page (e.g., page 1) in a process of forming an image on the recording medium 113 while conveying the recording medium 113 in the conveyance direction (cf. the arrow in the figure).

In this case, the controller 211 does not correct the drive waveform data within page 1. The controller 211 starts correcting the drive waveform data from a margin (e.g., a page interval) between page 1 and the next page (e.g. page 2). In this manner, the liquid droplet discharge device can suppress occurrence of an abnormal image on and after the next page.

Figure 17:
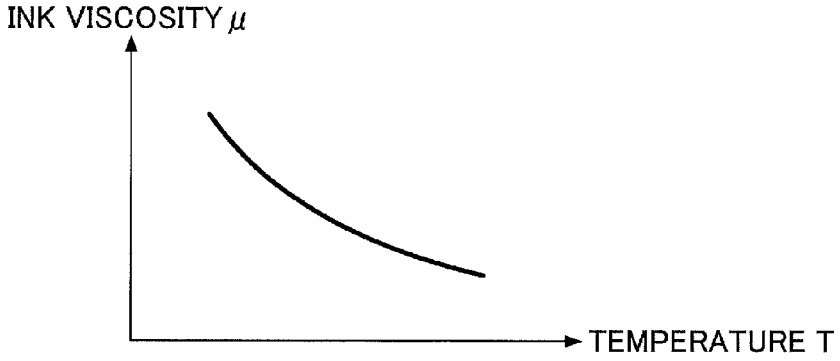
FIG. 17 is a diagram showing an example of a relationship between the ink viscosity $\mu$ and a temperature T.

FIG. 17 is a diagram showing a relationship between the temperature T and the ink viscosity p.

The controller 211 can calculate ink viscosity μ from the calculated damping ratio ζ based on FIG. 13, and the controller 211 can calculate the ink temperature T from the ink viscosity μ based on FIG. 17. Namely, the controller 211 can calculate the ink temperature T based on the calculated damping ratio ζ. Consequently, the temperature of the ink can be monitored without providing a thermistor or the like.

The liquid droplet discharge device according to the embodiment can effectively utilize the residual oscillation that can occur in the ink inside the pressure chamber after discharging the ink droplet. The controller can determine the ink viscosity based on the detection result by the residual oscillation detector that is fed back, and the controller can correct, for each of the nozzles, the drive waveform data. In this manner, an optimized drive waveform can be applied to each of the piezoelectric elements depending on a condition of the ink. Consequently, image quality of the inkjet recording device 100 can be enhanced.

Another Embodiment

An embodiment is explained in which piezoelectric elements that are to be installed in the inkjet recording head 220 are different from the piezoelectric elements 35 of the above-described embodiment. In contrast to the piezoelectric elements 35 of the above-described embodiment, the piezoelectric elements according to this embodiment may include a drive piezoelectric element (i.e., a piezoelectric element that is dedicated for driving) and a support piezoelectric element (i.e., a piezoelectric element that is used as a support) (cf. Japanese Patent No. 3933506).

Figure 18:
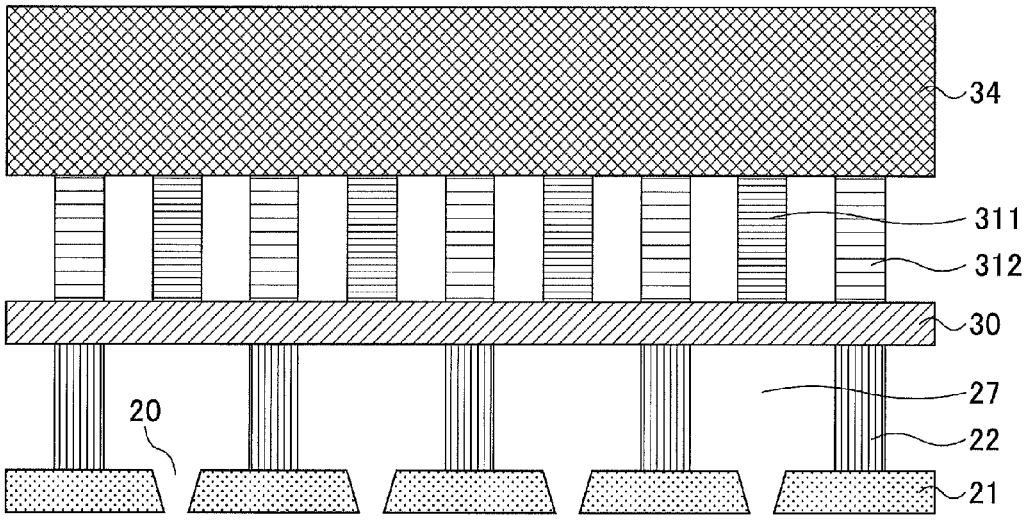
FIG. 18 is a sectional view schematically showing an example of an inkjet recording head according to another embodiment.

FIG. 18 is a schematic cross-sectional view showing an example of the inkjet recording head 220 according to the embodiment.

As shown in FIG. 18, piezoelectric elements may include drive piezoelectric elements 311 and support piezoelectric elements. The drive piezoelectric elements 311 and the support piezoelectric elements 312 can be alternately arranged. The drive piezoelectric element 311 can be formed at a position corresponding to the opening of the pressure chamber 27 through the oscillation plate 30. The support piezoelectric element 312 can be formed at a position corresponding to a partition wall of the pressure chamber 27 through the oscillation plate 30.

With the configuration that is shown in FIG. 18, not only the drive piezoelectric elements 311, but also the support piezoelectric elements 312 can be used for detecting the residual oscillation. Namely, the support piezoelectric elements 312 can always be used for detecting the residual oscillation. When the detection of the residual oscillation does not adversely affect on discharging (i.e., a case in which the piezoelectric elements are not driven), the drive piezoelectric elements 311 can be used for detecting the residual oscillation. Thus, in the line scan type inkjet recording device 100, during printing, a degree of freedom of selecting a timing for detecting the residual oscillation can be increased. Consequently, a time period (a time period for detecting the residual oscillation) that can be required for detecting the ink viscosity of all the nozzles 20 can be reduced. Furthermore, the configuration of the inkjet recording head 220 can be relatively simplified because it may not be necessary to newly provide a sensor.

Additionally, with the configuration that is shown in FIG. 18, even if a position displacement occurs during connecting the oscillation plate 30 and the piezoelectric elements 311 and 312, characteristic variations can be suppressed from occurring in the piezoelectric elements 311 and 312. Consequently, the discharging characteristic can be stabilized in the inkjet recording head 220.

Note that the configuration of the piezoelectric elements are not limited to the configuration that is shown in FIG. 18. It suffice if, at least, the residual oscillation can be detected by using the support piezoelectric elements 312 separately from the drive piezoelectric elements 311. Another sensor may be provided, so that all the piezoelectric elements can always be used for detecting the residual oscillation. As the other sensor, a pressure sensor for detecting the pressure of the pressure chamber 27, or an optical sensor (e.g., a displacement sensor, a speed sensor, or a camera) for detecting the fluctuation of the meniscus can be considered, for example.

Figure 19:
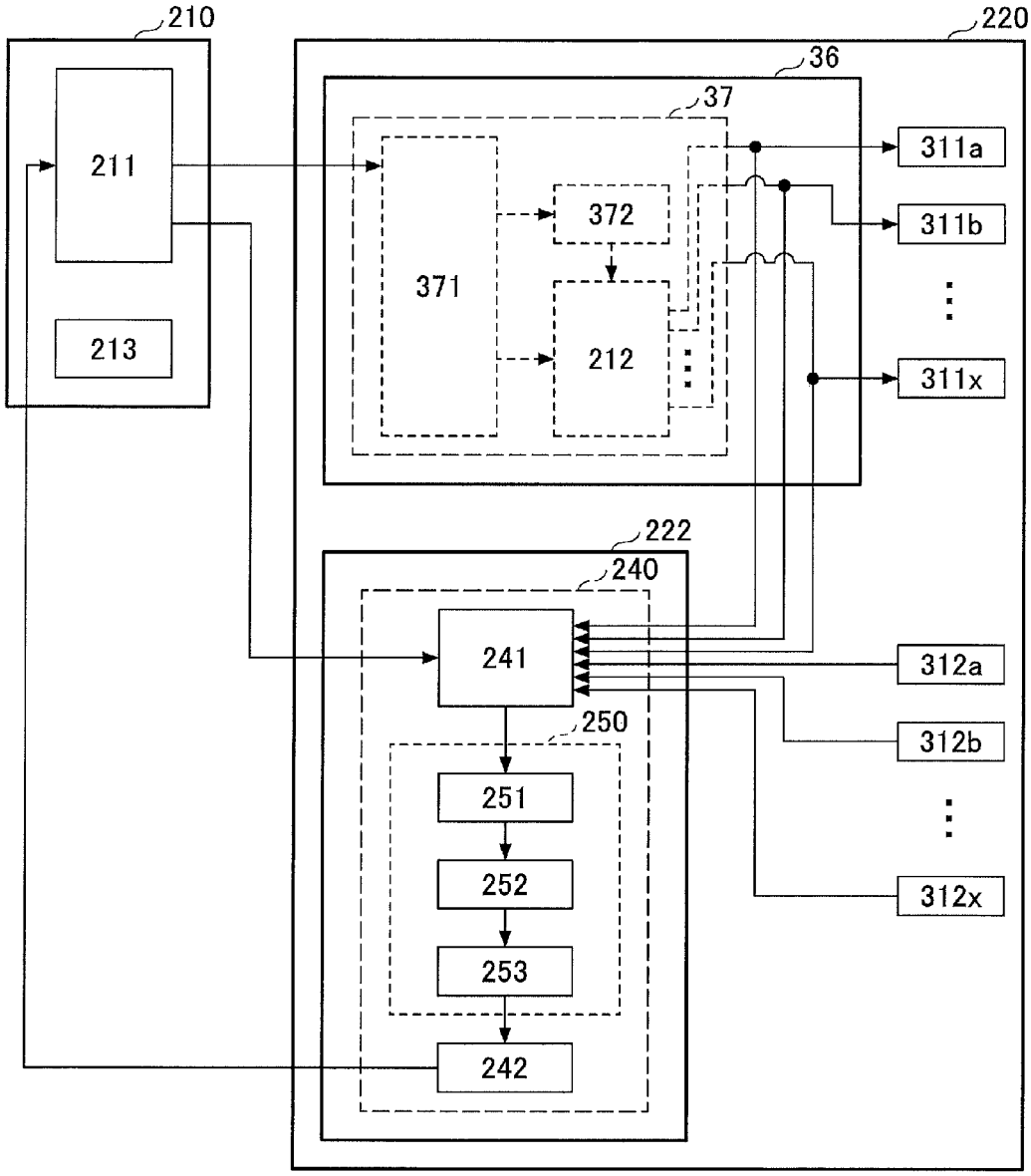
FIG. 19 is a block diagram showing an example of a functional configuration of the liquid droplet discharge device according to the other embodiment.

FIG. 19 is a block diagram showing an example of the inkjet recording head module 200 that is to be installed in the inkjet recording device 100 according to the embodiment.

As shown in FIG. 19, the drive piezoelectric elements 311 (the drive piezoelectric elements 311*a* to 311*x*) can be connected to the piezoelectric element driving IC 37 and the switching unit 241, and the drive piezoelectric elements 311 can be controlled based on the drive waveform that is output from the piezoelectric element driving IC 37. The drive piezoelectric elements 311 can be controlled by the piezoelectric element driving IC 37, so that the residual oscillation is not detected by using the drive piezoelectric elements 311 when the drive piezoelectric elements 311 are driven, and that the residual oscillation is detected by using the drive piezoelectric elements 311 when the drive piezoelectric elements 311 are not driven.

As shown in FIG. 19, the support piezoelectric elements 312 (the support piezoelectric elements 312*a* to 312*x*) can be connected to the switching unit 241, and the support piezoelectric elements 312 can be controlled based on a switching signal that is output from the controller 211. Thus, the support piezoelectric elements 312 can be controlled by the piezoelectric element driving IC 37, so that the residual oscillation can always be detected by using the support piezoelectric elements 312.

Figure 20:
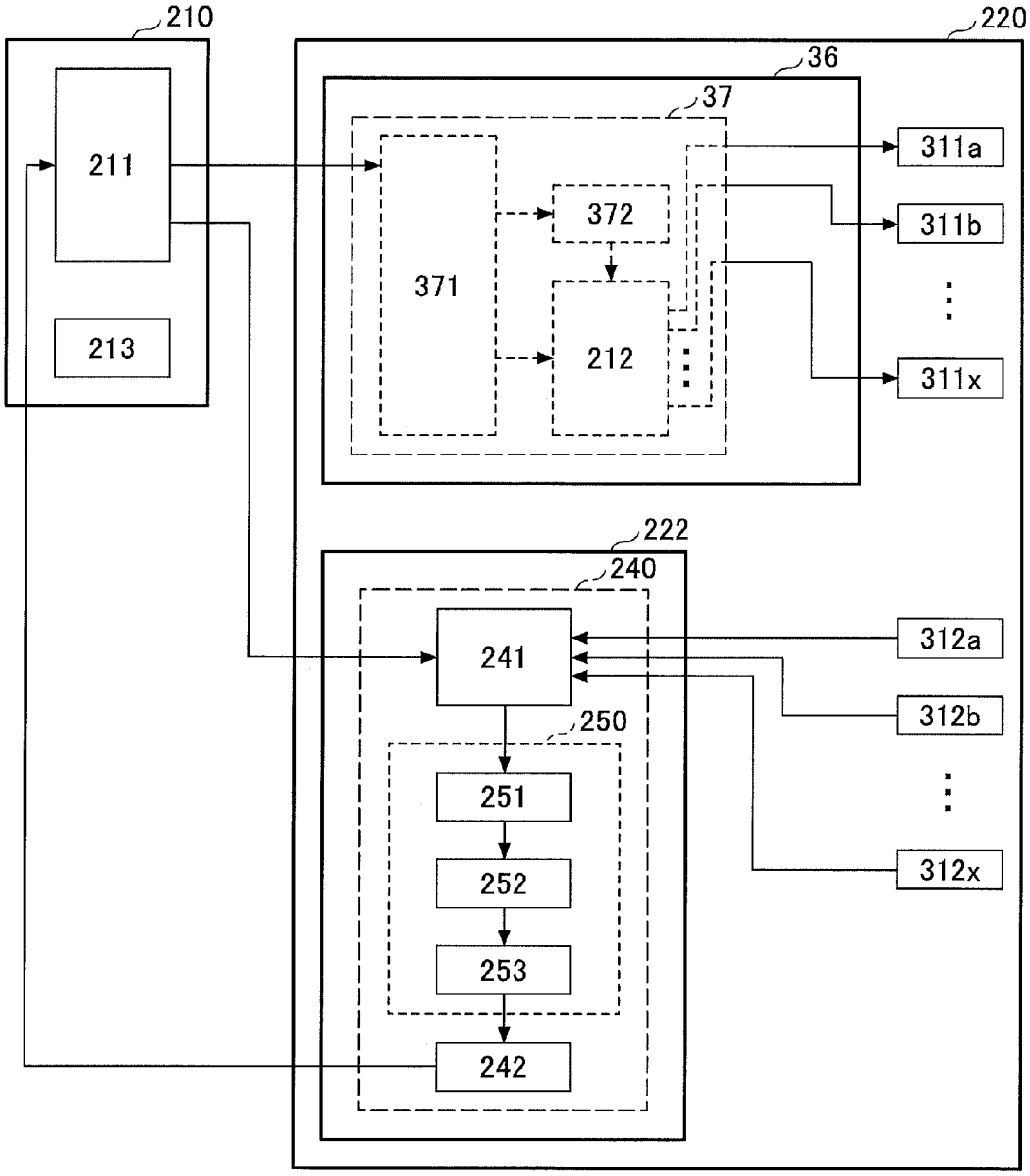
FIG. 20 is a block diagram showing another example of the functional configuration of the liquid droplet discharge device according to the other embodiment.

In FIG. 19, the residual oscillation can be detected not only by using the support piezoelectric elements 312, but also by using the drive piezoelectric elements 311. However, as shown in FIG. 20, only the support piezoelectric elements 312 can be used for detecting the residual oscillation.

Figure 21:
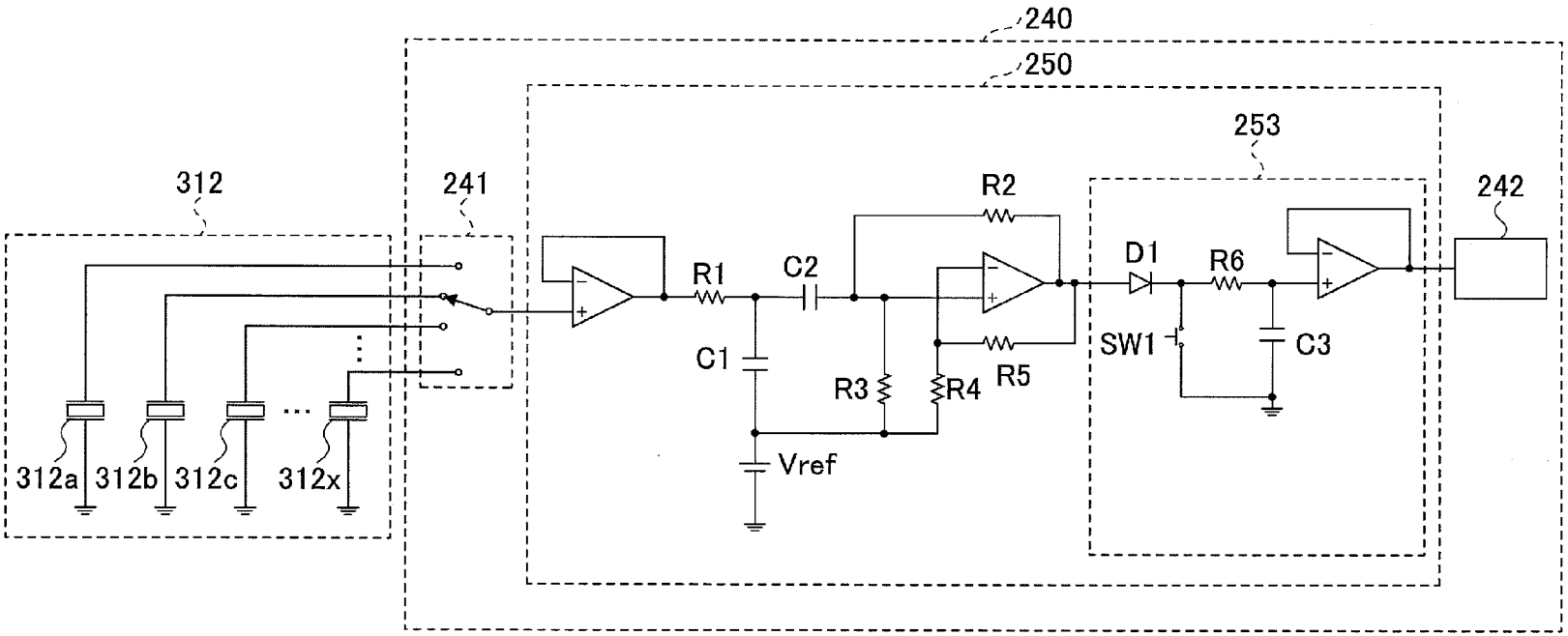
FIG. 21 is a circuit diagram showing an example of a circuit configuration of the liquid droplet discharge device according to the other embodiment.

FIG. 21 is a circuit diagram showing an example of the residual oscillation detector 240 according to the embodiment. FIG. 21 shows the circuit diagram of the example of the residual oscillation detector 240 for a case in which only the support piezoelectric elements 312 are used for detecting the residual oscillation (cf. FIG. 20).

FIG. 21 is different from FIG. 10 in a point that the piezoelectric elements that can be connected to the waveform processing circuit 250 through the switching unit 241 are different. In FIG. 11, the waveform processing circuit 250 can be connected to the drive piezoelectric elements (the piezoelectric elements 35*a* to 35*x*). In contrast, in FIG. 21, the waveform processing circuit 250 can be connected to the support piezoelectric elements 312. Except for that, the configuration shown in FIG. 21 is the same as the configuration shown in FIG. 11. Thus, detailed explanation is omitted.

In FIG. 21, the support piezoelectric elements 312 can be connected to the waveform processing circuit 250 through the switching unit 241 in synchronization with the timing for applying the drive waveform from the piezoelectric element driving IC 37 to the drive piezoelectric elements 311. In this manner, the residual oscillation detector 240 can detect a residual oscillation voltage that can be induced in the support piezoelectric elements 312, and the residual oscillation detector 240 can recognize the amplitude values of the residual oscillation waveform.

<Control Flowchart>

Figure 22:
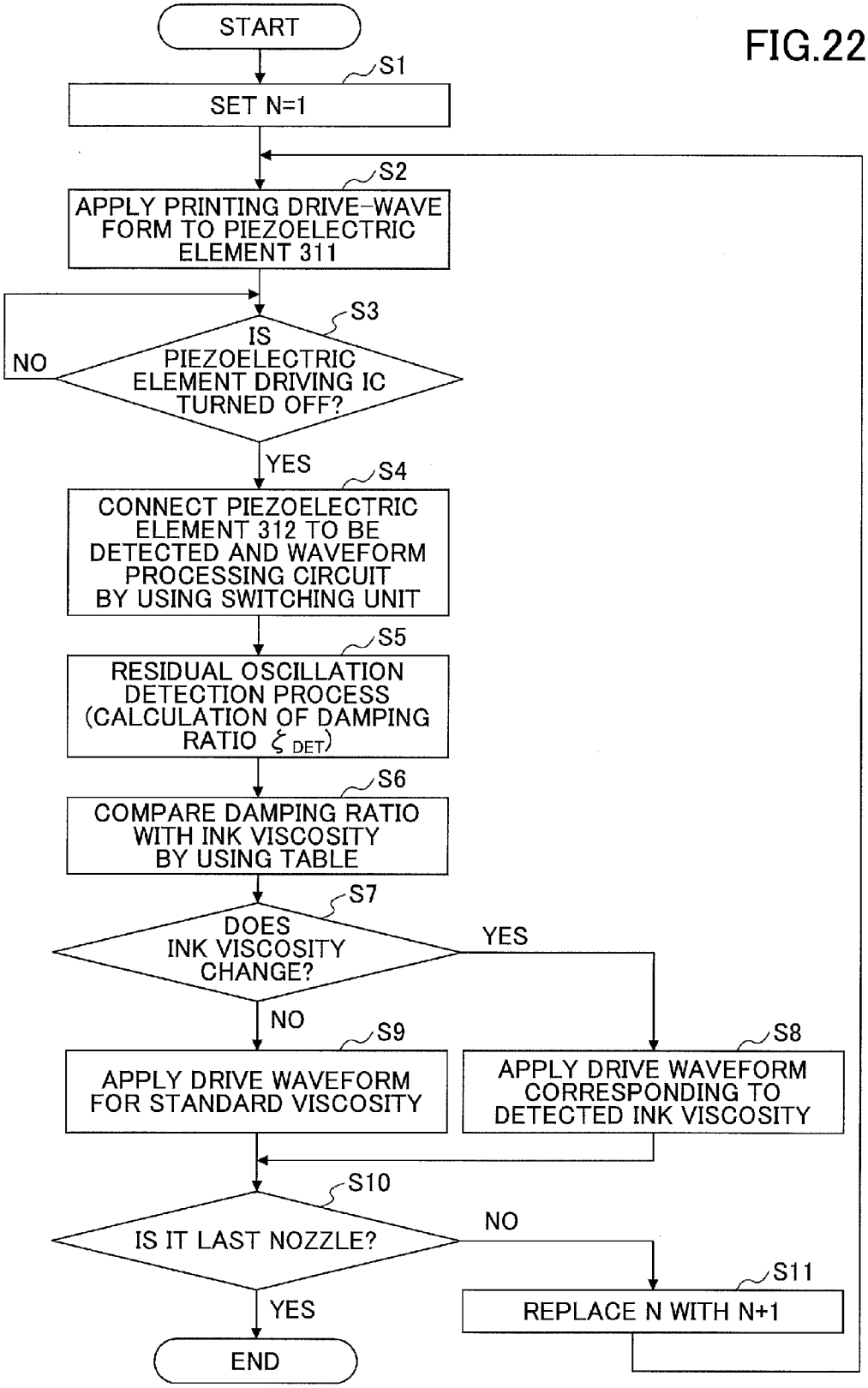
FIG. 22 is a flowchart illustrating an example of a control flow according to the other embodiment.

FIG. 22 is a control flowchart showing an example of a control flow of the line scan type inkjet recording device 100 according to the embodiment. The inkjet recording device 100 can be an on-demand type inkjet recording device. The control flowchart that is shown in FIG. 22 can be executed, for example, by the controller 211 in accordance with a control program.

At step S1, the controller 211 can set "n" to one so as to execute correction for each of the nozzles 20.

At step S2, the controller 211 applies a drive waveform for printing (for standard viscosity) to the drive piezoelectric elements 311 (the drive piezoelectric elements 311*a* to 311*x*) through the drive waveform generator 212.

At step S3, the controller 211 monitors the piezoelectric element driving IC 37, and the controller 211 determines whether the piezoelectric element driving IC 37 is turned off. In response to determining that the piezoelectric element driving IC 37 is turned off (YES), the controller 211 executes a process of step S4. In response to determining that the piezoelectric element driving IC 37 is not turned off (NO), the controller 211 continues monitoring the piezoelectric element driving IC 37 (the process of step S3 is executed again).

At step S4, the controller 211 establishes a connection between the support piezoelectric element 312 (one of the support piezoelectric elements 312*a* to 312*x*) that is to be detected and the waveform processing circuit 250 by using the switching unit 241.

At step S5, the controller 211 calculates the damping ratio $\zeta_{det}$ from the detection result (amplitude values) by the residual oscillation detector 240.

At step S6, the controller 211 compares the damping ratio $\zeta_{det}$ with the ink viscosity μ by using the table (cf. FIG. 13).

At step S7, the controller 211 determines whether the ink viscosity is changed based on the result of the comparison. In response to determining that the ink viscosity is changed (YES), the controller 211 executes a process of step S8. In response to determining that the ink viscosity is not changed (NO), the controller 211 executes a process of step S9.

At step S8, the controller 211 corrects the drive waveform data, and the controller 211 applies a drive waveform that corresponds to the detected ink viscosity to the drive piezoelectric element 311 (one of the drive piezoelectric elements 311*a* to 311*x*) through the drive waveform generator 212.

At step S9, the controller 211 leaves the drive waveform data uncorrected, and the controller 211 applies the drive waveform for the standard viscosity to the drive piezoelectric element 311 (one of the drive piezoelectric elements 311*a* to 311*x*) through the drive waveform generator 212.

At step S10, the controller 211 determines whether the current nozzle 20 is the last nozzle 20. In response to determining that the current nozzle 20 is the last nozzle 20 (YES), the controller 211 terminates the process. In response to determining that the current nozzle 20 is not the last nozzle 20 (NO), the controller 211 executes a process of step S11.

At step S10, the controller 211 increments "n" by "1," and the controller 211 applies the drive waveform for printing to the drive piezoelectric elements 311 (the drive piezoelectric elements 311*a* to 311*x*) through the drive waveform generator 212 (the process of step S2 is executed again).

Further Embodiment

Figure 23:
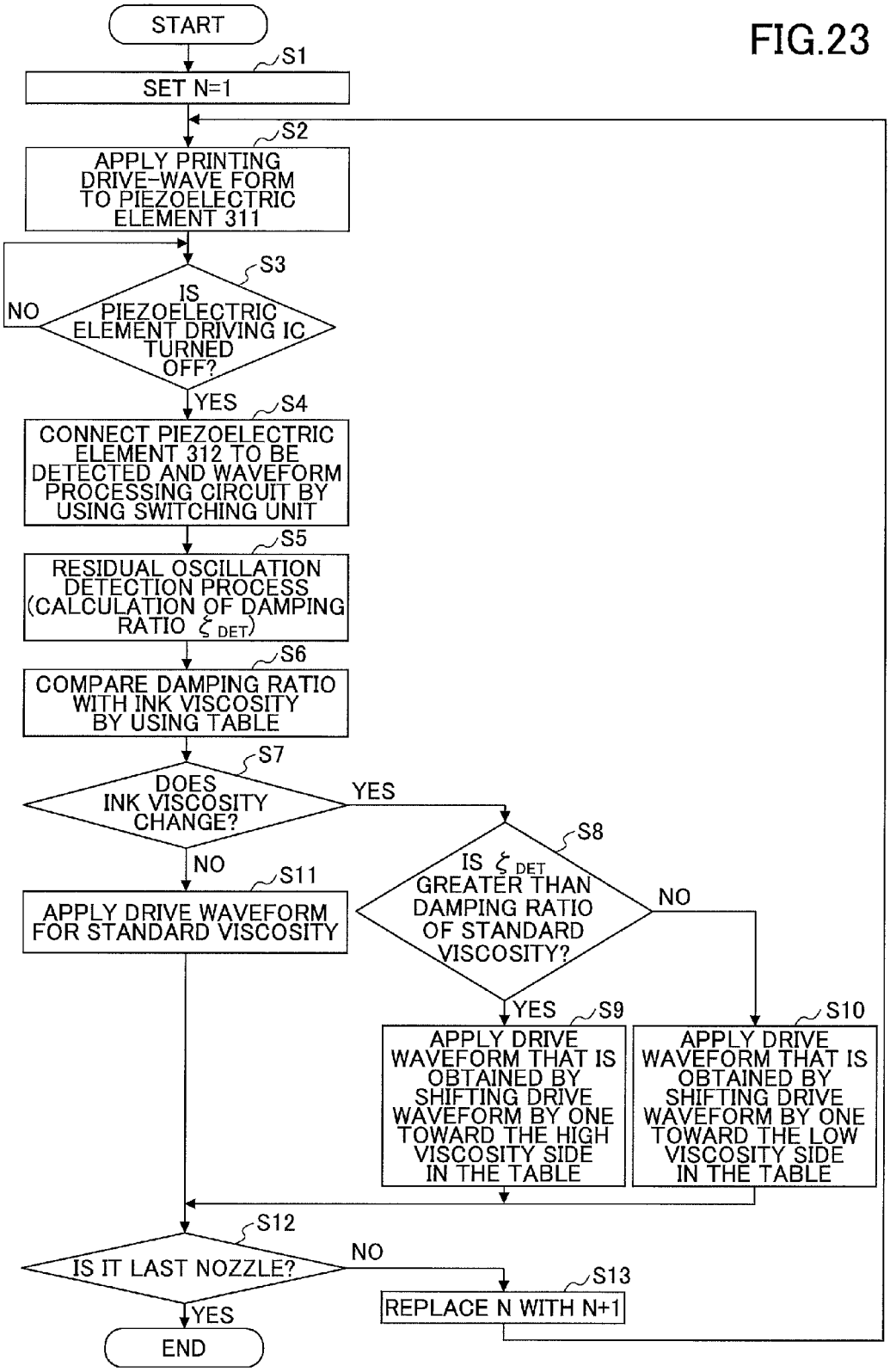
FIG. 23 is a flowchart illustrating an example of the control flow according to a further embodiment.

Hereinafter, there is explained a control flowchart according to a further embodiment that is different from that of the other embodiment. The control flowchart is for a case in which a configuration is adopted such that the support piezoelectric elements 312 are used for detecting the residual oscillation. FIG. 23 is a control flowchart showing an example of a control flow of the line scan type inkjet recording device 100 according to the embodiment. The inkjet recording device 100 can be an on-demand type inkjet recording device. The control flowchart that is shown in FIG. 23 can be executed, for example, by the controller 211 in accordance with a control program.

At step S1, the controller 211 can set "n" to one so as to execute correction for each of the nozzles 20.

At step S2, the controller 211 applies a drive waveform for printing (for standard viscosity) to the drive piezoelectric elements 311 (the drive piezoelectric elements 311*a* to 311*x*) through the drive waveform generator 212.

At step S3, the controller 211 monitors the piezoelectric element driving IC 37, and the controller 211 determines whether the piezoelectric element driving IC 37 is turned off. In response to determining that the piezoelectric element driving IC 37 is turned off (YES), the controller 211 executes a process of step S4. In response to determining that the piezoelectric element driving IC 37 is not turned off (NO), the controller 211 continues monitoring the piezoelectric element driving IC 37 (the process of step S3 is executed again).

At step S4, the controller 211 establishes a connection between the support piezoelectric element 312 (one of the support piezoelectric elements 312*a* to 312*x*) that is to be detected and the waveform processing circuit 250 by using the switching unit 241.

At step S5, the controller 211 calculates the damping ratio $\zeta_{det}$ from the detection result (amplitude values) by the residual oscillation detector 240.

At step S6, the controller 211 compares the damping ratio $\zeta_{det}$ with the ink viscosity μ by using the table (cf. FIG. 13).

At step S7, the controller 211 determines whether the ink viscosity is changed based on the result of the comparison. In response to determining that the ink viscosity is changed (YES), the controller 211 executes a process of step S8. In response to determining that the ink viscosity is not changed (NO), the controller 211 executes a process of step S11.

At step S8, the controller 211 determines whether the damping ratio $\zeta_{det}$ is greater than the damping ratio of the standard viscosity. In response to determining that the damping ratio $\zeta_{det}$ is greater than the damping ratio of the standard viscosity (YES), the controller 211 executes a process of step S9. In response to determining that the damping ratio $\zeta_{det}$ is less than or equal to the damping ratio of the standard viscosity (NO), the controller 211 executes a process of step S10.

At step S9, the controller 211 corrects the drive waveform data, and the controller 211 applies, to the drive piezoelectric element 311 (one of the drive piezoelectric elements 311*a* to 311*x*), a drive waveform that is obtained by shifting by one toward the high viscosity side in the table through the drive waveform generator 212. In this manner, the ink discharge speed and the discharge amount can be corrected without applying a rapid voltage change to the piezoelectric element 311. Consequently, the piezoelectric elements 311 can be prevented from being deteriorated.

At step S10, the controller 211 corrects the drive waveform data, and the controller 211 applies, to the drive piezoelectric element 311 (one of the drive piezoelectric elements 311*a* to 311*x*), a drive waveform that is obtained by shifting by one toward the low viscosity side in the table through the drive waveform generator 212. In this manner, the ink discharge speed and the discharge amount can be corrected without applying a rapid voltage change to the piezoelectric element 311. Consequently, the piezoelectric elements 311 can be prevented from being deteriorated.

At step S11, the controller 211 leaves the drive waveform data uncorrected, and the controller 211 applies the drive waveform for the standard viscosity to the drive piezoelectric element 311 (one of the drive piezoelectric elements 311*a* to 311*x*) through the drive waveform generator 212.

At step S12, the controller 211 determines whether the current nozzle 20 is the last nozzle 20. In response to determining that the current nozzle 20 is the last nozzle 20 (YES), the controller 211 terminates the process. In response to determining that the current nozzle 20 is not the last nozzle 20 (NO), the controller 211 executes a process of step S13.

At step S13, the controller 211 increments "n" by "1," and the controller 211 applies the drive waveform for printing to the drive piezoelectric elements 311 (the drive piezoelectric elements 311*a* to 311*x*) through the drive waveform generator 212 (the process of step S2 is executed again).

The liquid droplet discharge device, the liquid droplet discharge method, and the non-transitory storage medium storing the program are explained above by the embodiments. However, the present invention is not limited to the embodiments, and various modifications and improvements may be made within the scope of the present invention. Specific examples of numerical values are used in order to facilitate understanding of the invention. However, these numerical values are simply illustrative, and any other appropriate values may be used, except as indicated otherwise. The separations of the items in the above-described explanation are not essential to the present invention. Depending on necessity, subject matter described in two or more items may be combined and used, and subject matter described in an item may be applied to subject matter described in another item (provided that they do not contradict). A boundary of a functional unit or a processing unit in a functional block does not necessarily correspond to a boundary of a physical component. An operation by a plurality of functional units may be physically executed by a single component. Alternatively, an operation by a single functional unit may be physically executed by a plurality of components. For the convenience of explanation, the devices according to the embodiment of the present invention are explained by using the functional block diagrams. However, these devices may be implemented in hardware, software, or combinations thereof. The software that operates in accordance with the present invention may be prepared in any appropriate storage medium, such as a random access memory (RAM), a flash memory, a read-only memory (ROM), an EPROM, an EEPROM, a register, a hard disk drive (HDD), a removable disk, a CD-ROM, a database, a server, and the like.

The present invention can be implemented in any convenient form, for example using dedicated hardware, or a mixture of dedicated hardware and software. The present invention may be implemented as computer software implemented by one or more network processing apparatuses. The network can comprise any conventional terrestrial or wireless communications network, such as the Internet. The processing apparatuses can compromise any suitable programmed apparatuses such as a general-purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, a hard disk, a CD ROM, a magnetic tape device or a solid state memory device. The hardware platform includes any desired hardware resources including, for example, a central processing unit (CPU), a random access memory (RAM), and a hard disk drive (HDD). The CPU may include processors of any desired kinds and numbers. The RAM may include any desired volatile or nonvolatile memories. The HDD may include any desired nonvolatile memories capable of recording a large amount of data. The hardware resources may further include an input device, an output device, and a network device in accordance with the type of the apparatus. The HDD may be provided external to the apparatus as long as the HDD is accessible from the apparatus. In this case, the CPU, for example, the cache memory of the CPU, and the RAM may operate as a physical memory or a primary memory of the apparatus, while the HDD may operate as a secondary memory of the apparatus.

The present application is based on and claims the benefit of priority of Japanese Priority Application No. 2014-213008 filed on Oct. 17, 2014, the entire contents of which are hereby incorporated herein by reference.

What is claimed is:

1. A liquid droplet discharge device comprising:

a plurality of pressure chambers in communication with a plurality of nozzles, wherein the pressure chambers are configured to store ink;

an oscillation plate that is disposed over the pressure chambers, so that an elastic wall of each of the pressure chambers is formed;

pressure generating elements that are disposed to face the plurality of the pressure chambers through the oscillation plate;

a drive waveform generator provided to each of the nozzles and configured to generate, for said each of the nozzles, a drive waveform by using, as an input, drive waveform data that indicates a shape of the drive waveform for driving the corresponding pressure generating element;

a residual oscillation detector configured to detect residual oscillation that is generated in each of the pressure chambers after driving the pressure generating elements; and a controller configured to correct, during printing, the drive waveform data for said each of the nozzles, based on a detection result by the residual oscillation detector.

2. The liquid droplet discharge device according to claim 1, wherein the controller is configured to correct the drive waveform data from a liquid droplet immediately after a liquid droplet in which a change in ink viscosity is detected.

3. The liquid droplet discharge device according to claim 1, wherein the controller is configured to start correcting the drive waveform data from a margin of a recording medium.

4. The liquid droplet discharge device according to claim 1, wherein the pressure generating elements are used for the residual oscillation detector.

5. The liquid droplet discharge device according to claim 4, wherein a support pressure generating element is used for the residual oscillation detector.

6. The liquid droplet discharge device according to claim 5, wherein the support pressure generating element is disposed to face a partition wall that is disposed between the pressure chambers.

7. The liquid droplet discharge device according to claim 1, wherein the residual oscillation detector is configured to output a damping ratio of a residual oscillation waveform.

8. The liquid droplet discharge device according to claim 7, wherein the controller is configured to correct the drive waveform data so that the damping ratio is within a predetermined range.

9. A liquid droplet discharge method that is to be executed by a liquid droplet discharge device, wherein the liquid droplet discharge device includes a plurality of pressure chambers in communication with a plurality of nozzles, wherein the pressure chambers are configured to store ink;

an oscillation plate that is disposed over the pressure chambers, so that an elastic wall of each of the pressure chambers is formed;

pressure generating elements that are disposed to face the plurality of the pressure chambers through the oscillation plate;

a drive waveform generator provided to each of the nozzles and configured to generate, for said each of the nozzles, a drive waveform by using, as an input, drive waveform data that indicates a shape of the drive waveform for driving the corresponding pressure generating element; and a residual oscillation detector configured to detect residual oscillation that is generated in each of the pressure chambers after driving the pressure generating elements, and wherein the method includes a step of correcting, during printing, the drive waveform data for the each of the nozzles, based on a detection result by the residual oscillation detector.

10. A non-transitory storage medium storing a program that is to be executed by a liquid droplet discharge device, wherein the liquid droplet discharge device includes a plurality of pressure chambers in communication with a plurality of nozzles, wherein the pressure chambers are configured to store ink;

an oscillation plate that is disposed over the pressure chambers, so that an elastic wall of each of the pressure chambers is formed;

pressure generating elements that are disposed to face the plurality of the pressure chambers through the oscillation plate;

a drive waveform generator provided to each of the nozzles and configured to generate, for said each of the nozzles, a drive waveform by using, as an input, drive waveform data that indicates a shape of the drive waveform for driving the corresponding pressure generating element; and a residual oscillation detector configured to detect residual oscillation that is generated in each of the pressure chambers after driving the pressure generating elements, and wherein the program causes the liquid discharge device to execute a process of correcting, during printing, the drive waveform data for the each of the nozzles, based on a detection result by the residual oscillation detector.

* * * * *